US011865422B2

(12) United States Patent
Goodman et al.

(10) Patent No.: US 11,865,422 B2
(45) Date of Patent: Jan. 9, 2024

(54) ANTIMICROBIAL BASKETBALL NET

(71) Applicant: AVIV, LLC, Baltimore, MD (US)

(72) Inventors: Tamir Goodman, Jerusalem (IL); David Warschawski, Baltimore, MD (US); Amit Ronkin, Ramot Hashavim (IL)

(73) Assignee: AVIV, LLC, Baltimore, MD (US)

( * ) Notice: Subject to any disclaimer, the term of this patent is extended or adjusted under 35 U.S.C. 154(b) by 0 days.

(21) Appl. No.: 18/246,805

(22) PCT Filed: Feb. 24, 2022

(86) PCT No.: PCT/US2022/017679
§ 371 (c)(1),
(2) Date: Mar. 27, 2023

(87) PCT Pub. No.: WO2022/197414
PCT Pub. Date: Sep. 22, 2022

(65) Prior Publication Data

US 2023/0285818 A1 Sep. 14, 2023

Related U.S. Application Data

(60) Provisional application No. 63/162,109, filed on Mar. 17, 2021.

(51) Int. Cl.

| | |
|---|---|
| ***A63B 63/08*** | (2006.01) |
| ***A63B 47/04*** | (2006.01) |
| ***D02G 3/44*** | (2006.01) |

(52) U.S. Cl.
CPC ..... *A63B 63/083* (2013.01); *A63B 47/04* (2013.01); *D02G 3/444* (2013.01); *D02G 3/449* (2013.01); *A63B 2209/00* (2013.01)

(58) Field of Classification Search
CPC ... A63B 63/083; A63B 47/04; A63B 2209/00; D02G 3/444; D02G 3/449
See application file for complete search history.

(56) References Cited

U.S. PATENT DOCUMENTS

| | | | |
|---|---|---|---|
| 2,199,609 | A | 5/1940 | Bennett |
| 2,214,925 | A | 9/1940 | Guthrie |

(Continued)

FOREIGN PATENT DOCUMENTS

| | | | |
|---|---|---|---|
| CA | 2472410 | A1 | 12/2005 |
| CA | 2930692 | A1 | 6/2015 |

(Continued)

OTHER PUBLICATIONS

Non-Final Office Action, U.S. Appl. No. 17/679,658, dated Jun. 28, 2022, 23 pages.

(Continued)

*Primary Examiner* — Jeffrey S Vanderveen
(74) *Attorney, Agent, or Firm* — MEDLER FERRO WOODHOUSE & MILLS PLLC

(57) ABSTRACT

A basketball net includes a multi-layer cord including each of an outer layer formed of a first antimicrobial, moisture wicking fiber and an inner layer including a second antimicrobial, moisture wicking fiber. The outer layer is woven from a first antimicrobial, moisture wicking yarn to form a wall that defines a central opening, and at least one cord is located within the central opening, the at least one cord formed by a second antimicrobial, moisture wicking yarn. The at least one cord includes a plurality of cords including a first cord formed by the second antimicrobial, moisture wicking yarn and a second cord including a third antimicrobial, moisture wicking yarn. The plurality of cords includes: the first cord; the second cord including the third antimicrobial, moisture wicking yarn and at least one mono- (Continued)

fiber yarn; and a third cord formed by a plurality of monofiber yarns.

26 Claims, 13 Drawing Sheets

(56) References Cited

U.S. PATENT DOCUMENTS

| | | | |
|---|---|---|---|
| 2,382,355 | A | 8/1945 | Warren |
| D159,895 | S | 8/1950 | Douglas et al. |
| 2,579,312 | A | 12/1951 | Garvey |
| 2,616,468 | A | 11/1952 | Brady |
| 2,960,984 | A | 11/1960 | Parker |
| 3,204,957 | A | 9/1965 | Logue |
| 3,227,419 | A | 1/1966 | Lackey |
| 3,399,671 | A | 9/1968 | Donatas |
| RE27,067 | E | 2/1971 | Michael |
| 3,964,197 | A | 6/1976 | Tucker et al. |
| 4,001,367 | A | 1/1977 | Guthrie et al. |
| 4,071,239 | A | 1/1978 | Ferguson |
| 5,035,805 | A | 7/1991 | Freeman et al. |
| 5,133,371 | A | 7/1992 | Sivess |
| 5,215,379 | A | 6/1993 | Pickard et al. |
| 5,280,904 | A | 1/1994 | Rodriguez |
| 5,313,668 | A | 5/1994 | Bogan et al. |
| 5,394,638 | A | 3/1995 | Raymond et al. |
| 5,458,325 | A | 10/1995 | Klein et al. |
| 5,460,365 | A | 10/1995 | Payne |
| 5,472,280 | A | 12/1995 | Rittmaster |
| 5,551,177 | A | 9/1996 | Cowgill et al. |
| 5,685,016 | A | 11/1997 | Douglas |
| 5,715,804 | A | 2/1998 | Izuta |
| 5,715,881 | A | 2/1998 | Ruskamp et al. |
| 5,728,336 | A | 3/1998 | Gogolewski |
| 5,836,488 | A | 11/1998 | Priestley |
| 5,899,010 | A | 5/1999 | Peck |
| 5,944,623 | A | 8/1999 | Schlicting |
| 6,237,267 | B1 | 5/2001 | Lackomar |
| 6,322,465 | B1 | 11/2001 | Gentile |
| 6,357,510 | B1 | 3/2002 | Zheng |
| 6,427,242 | B1 | 8/2002 | Bush et al. |
| 6,450,513 | B1 | 9/2002 | Bernstein |
| 6,607,456 | B2 | 8/2003 | Yu |
| 6,634,531 | B2 | 10/2003 | Conte |
| 6,688,026 | B1 | 2/2004 | Clark |
| 6,857,134 | B1 | 2/2005 | Cowell |
| 6,869,464 | B2 | 3/2005 | Klemic |
| 7,021,825 | B1 | 4/2006 | Schultz |
| 7,076,898 | B1 | 7/2006 | Hunt |
| 7,086,189 | B2 | 8/2006 | Morris et al. |
| 7,117,619 | B1 | 10/2006 | Huber |
| 7,131,225 | B2 | 11/2006 | Wu |
| 7,553,245 | B2 | 6/2009 | Dones |
| D600,755 | S | 9/2009 | O'Brien |
| 7,984,724 | B1 | 7/2011 | Eberle |
| 8,183,167 | B1 | 5/2012 | Delattre et al. |
| 8,283,021 | B2 | 10/2012 | Ashida et al. |
| 8,474,166 | B2 | 7/2013 | Reynolds |
| D697,149 | S | 1/2014 | Heck |
| 8,832,981 | B2 | 9/2014 | Desaulniers |
| 9,466,234 | B1 | 10/2016 | DeMarco et al. |
| 9,653,008 | B2 | 5/2017 | Pelletier |
| 9,724,580 | B2 | 8/2017 | Goldwitz |
| 10,039,333 | B2 | 8/2018 | Hamilton et al. |
| 10,111,506 | B1 | 10/2018 | Brenner |
| 10,456,644 | B2 | 10/2019 | OMeara et al. |
| 10,743,594 | B2 | 8/2020 | Vann, Jr. |
| 2002/0119843 | A1 | 8/2002 | Yu |
| 2003/0190985 | A1 | 10/2003 | Neiberger et al. |
| 2004/0077246 | A1 | 4/2004 | Travelute et al. |
| 2004/0187471 | A1* | 9/2004 | Andrews ..... D02G 3/442 57/232 |
| 2004/0266546 | A1 | 12/2004 | Huang |
| 2005/0119074 | A1 | 6/2005 | Waite et al. |
| 2005/0221921 | A1 | 10/2005 | Beane |
| 2006/0212996 | A1 | 9/2006 | McGrath |
| 2006/0258488 | A1 | 11/2006 | Lamson et al. |
| 2007/0010357 | A1 | 1/2007 | Matthew |
| 2007/0048326 | A1 | 3/2007 | Cairns et al. |
| 2007/0060420 | A1 | 3/2007 | Bradford |
| 2008/0057817 | A1 | 3/2008 | Aoki |
| 2008/0280706 | A1 | 11/2008 | Yu |
| 2009/0201597 | A1 | 8/2009 | Lindblad et al. |
| 2009/0233738 | A1 | 9/2009 | Yu |
| 2010/0190588 | A1 | 7/2010 | Yu |
| 2010/0282426 | A1 | 11/2010 | Sawda et al. |
| 2011/0263356 | A1 | 10/2011 | Silagy |
| 2013/0172131 | A1 | 7/2013 | Bove et al. |
| 2013/0178779 | A1 | 7/2013 | Duda |
| 2014/0057744 | A1 | 2/2014 | Whitten |
| 2015/0041172 | A1 | 2/2015 | Garies |
| 2015/0065276 | A1 | 3/2015 | Roser |
| 2016/0237602 | A1 | 8/2016 | Pritchett et al. |
| 2017/0027719 | A1 | 2/2017 | Bache et al. |
| 2018/0249804 | A1 | 9/2018 | Walker et al. |
| 2019/0194843 | A1 | 6/2019 | Alexander et al. |
| 2019/0217172 | A1* | 7/2019 | OMeara ..... G09F 23/0066 |
| 2020/0114233 | A1 | 4/2020 | Deal |
| 2020/0139644 | A1 | 5/2020 | Ogale |
| 2020/0190708 | A1 | 6/2020 | Luo et al. |
| 2020/0323316 | A1 | 10/2020 | Lui et al. |
| 2021/0370142 | A1 | 12/2021 | Ou |
| 2022/0032151 | A1 | 2/2022 | Wilson |
| 2022/0296976 | A1 | 9/2022 | Goodman et al. |
| 2022/0339511 | A1 | 10/2022 | Goodman et al. |

FOREIGN PATENT DOCUMENTS

| | | | |
|---|---|---|---|
| CN | 208808772 | U | 5/2019 |
| CN | 210384197 | U | 4/2020 |
| CN | 210636128 | U | 5/2020 |
| CN | 212247326 | U | 12/2020 |
| GB | 2468154 | B | 10/2013 |
| GB | 2573159 | A | 10/2019 |
| JP | 2001310006 | A | 11/2001 |
| JP | 2016079594 | A | 5/2016 |
| KR | 20150003479 | U | 9/2015 |
| WO | 2010097565 | A1 | 9/2010 |

OTHER PUBLICATIONS

Final Office Action, U.S. Appl. No. 17/679,658, dated Oct. 31, 2022, 22 pages.

Non-Final Office Action, U.S. Appl. No. 17/679,658, dated May 26, 2023, 18 pages.

International Search Report and Written Opinion, dated Jul. 5, 2022, for corresponding International Application No. PCT/US22/17679.

* cited by examiner

ANTIMICROBIAL BASKETBALL NET

BACKGROUND OF INVENTION

1. Field of Invention

This invention relates generally to basketball nets. More specifically, at least one embodiment, relates to a basketball net that removes moisture and germs from a basketball as the basketball drops through the net.

2. Discussion of Related Art

Referring to FIG. 1, a traditional basketball goal 100 is illustrated. The basketball goal 100 includes a rim 102, a basketball net 103 and a backboard 104. The basketball goal 100 can be secured in place such that the rim 102 is located at the desired elevation, for example, at a regulation height, or perhaps a lower height when used by children. While the basketball goal 100 may be wall mounted, ceiling suspended or secured in place by other means, basketball goals are most often secured to a pole for use in recreational basketball.

The basketball net 103 is traditionally constructed to provide an overall conical shape. The materials of construction can include cotton, polyester or metal (chain link). Regardless of the materials of construction, the typical basketball net 103 includes a series of openings having a generally overall triangle or diamond-like shape where the upper part of the net 103 includes larger openings and the lower part of the net 103 includes smaller diamond-shaped openings. The loops that form the uppermost openings in the basketball net 103 are attached to the rim 102. When a basketball is thrown through the net 103, the descent of the ball is slowed and partially guided as the ball passes through the net 103.

During a game, the basketball is constantly changing hands. During play some basketball players find the basketball slippery due to moisture and sweat that gets transferred from the players' hands to the ball while handling it. A slippery feeling basketball gives the athlete less control of the ball while dribbling, passing and shooting. To improve the precision of their ball handling, athletes may run to the sidelines and wipe their hands on a towel, or alternatively, wipe their hands on their shorts or jersey to wipe off some of the moisture. These practices are routine at all levels of competition. Further, while the effort may temporarily give the athlete dry hands it does not remove any of the moisture from the basketball. As a result, the fundamental problem caused by sweat on the basketball remains.

Sometimes, a game or practice is temporarily halted so that the ball can be wiped down with a towel to dry it. However, these interruptions stop the flow or momentum of the game and are frustrating to players, coaches, referees and fans.

In addition to moisture, germs are also transferred onto the ball from the sweat and contact with the hands of the athletes. This leads to an accumulation of germs as the ball continually changes hands during a game or practice. As the germs accumulate, the basketball continues to change hands leading to an increasingly unhygienic situation. These circumstances create an environment that can easily transmit infections among the participants.

Further, the towels that are available courtside during a basketball game are unsanitary because they are thrown on the bench or the gym floor and because the same towel is used repeatedly to remove sweat. As a result, wiping the ball down with a towel does not reduce germs. Instead, the towel may actually transmit germs to the surface of the ball.

SUMMARY OF INVENTION

Therefore, there is a need for apparatus, systems and methods that reduce the risk of transmission of an infectious disease via a basketball. There is also a need for apparatus, systems and methods that assist in removing both germs and moisture such as sweat from a basketball. According to various embodiments, a basketball net includes one or a combination of antimicrobial, odor resistant, moisture absorbing and moisture wicking properties. According to these embodiments, the basketball net operates to clean the surface of the basketball as the basketball descends through the net. These embodiments provide an approach that increases the hygiene of gameplay and gives players better control of the basketball without the need to interrupt play or change basketballs.

During the current Covid-19 pandemic there is a heightened awareness and need to practice additional measures of hygiene to prevent the spread of germs and disease.

According to one aspect, a basketball net, includes a multi-layer cord including each of an outer layer formed of a first antimicrobial, moisture wicking fiber and an inner layer including a second antimicrobial, moisture wicking fiber. In some embodiments, the outer layer is woven from a first antimicrobial, moisture wicking yarn to form a wall that defines a central opening, and at least one cord is located within the central opening, the at least one cord formed by a second antimicrobial, moisture wicking yarn. In one embodiment, the at least one cord includes a plurality of cords including a first cord formed by the second antimicrobial, moisture wicking yarn and a second cord including a third antimicrobial, moisture wicking yarn. In a further embodiment, the plurality of cords includes: the first cord; the second cord including the third antimicrobial, moisture wicking yarn and at least one monofiber yarn; and a third cord formed by a plurality of monofiber yarns.

According to another aspect, a basketball goal includes a backboard, a rim configured to secure to the backboard and a basketball net configured to hang from the rim, the basketball net includes a multi-layer cord including each of an outer layer formed of a first antimicrobial, moisture wicking fiber and an inner layer including a second antimicrobial, moisture wicking fiber. In some embodiments, the outer layer is woven from a first antimicrobial, moisture wicking yarn to form a wall that defines a central opening, and at least one cord is located within the central opening, the at least one cord formed by a second antimicrobial, moisture wicking yarn. In one embodiment, the at least one cord includes a plurality of cords including a first cord formed by the second antimicrobial, moisture wicking yarn and a second cord including a third antimicrobial, moisture wicking yarn. In a further embodiment, wherein the plurality of cords includes: the first cord; the second cord including the third antimicrobial, moisture wicking yarn and at least one monofiber yarn; and a third cord formed by a plurality of monofiber yarns.

According to still another aspect, a method of fabricating a basketball net is provided. In some embodiments, the method includes acts of: providing a first yarn having both antimicrobial properties and moisture wicking properties; providing a second yarn having both antimicrobial properties and moisture wicking properties; fabricating an outer cord of the basketball net from the first yarn, the outer cord defining a central axial opening within the outer cord;

fabricating an inner cord of the basketball net with the second yarn; and fabricating a net-cord material by locating the inner cord longitudinally within the central axial opening.

In some embodiments, the method includes manufacturing the first yarn from a first synthetic fiber having antimicrobial nanoparticles distributed within the first synthetic fiber, and manufacturing the second yarn from a second synthetic fiber having antimicrobial nanoparticles distributed within the second synthetic fiber. In one embodiment, the inner cord is a first inner cord, and the method includes: manufacturing a third yarn from a plurality of synthetic monofibers; fabricating a second inner cord of the basketball net with the third yarn; and fabricating the net-cord material by locating the second inner cord longitudinally within the central axial opening. In another embodiment, where the synthetic monofiber is a first synthetic monofiber, the method includes: manufacturing a fourth yarn from third synthetic fiber having antimicrobial nanoparticles distributed within the third synthetic fiber; manufacturing a fifth yarn from a plurality of synthetic monofibers; fabricating a third inner cord from a combination of the fourth yarn and the fifth yarn; and fabricating the net-cord material by locating the third inner cord longitudinally within the central axial opening.

In still another aspect, an antimicrobial, moisture wicking material for sports netting includes a multi-layer cord including each of an outer layer formed of a first antimicrobial, moisture wicking fiber and an inner layer including a second antimicrobial, moisture wicking fiber. In some embodiments, the outer layer is woven from a first antimicrobial, moisture wicking yarn to form a wall that defines a central opening, and at least one cord is located within the central opening, the at least one cord formed by a second antimicrobial, moisture wicking yarn.

According to another aspect, a specialty basketball net is manufactured from high-performance material with moisture wicking, moisture absorbent, anti-odor and/or antimicrobial properties. According to some embodiments, the basketball net is sized and configured to be hung from a basketball rim inside a conventional net. In various embodiments, a color of the specialty net is customizable. For example, the color can be selected to highlight the increased player safety aspect provided by the specialty net. This can include the use of fluorescent, day-glow or other Hi-Viz colors.

According to yet another aspect, an otherwise conventional basketball net includes added strings secured to the conventional basketball net. According to these embodiments, these added strings are manufactured from high-performance material with moisture wicking, moisture absorbent, anti-odor and/or antimicrobial properties. The strings can be secured on the inside of the central opening of the conventional basketball net.

According to still another aspect, a basketball net includes large diameter knots. According to these embodiments, large diameter knots include high-performance material with moisture wicking, moisture absorbent, anti-odor and/or antimicrobial properties. In some embodiments, the large diameter knots are located only in a central region of the net.

As used herein, the term "antimicrobial" when used to refer to a compound, process or product means that the compound, process or product includes the characteristic of destroying or inhibiting the growth of microorganisms including both bacteria and viruses. Those of ordinary skill in the art will recognize based on the disclosure herein that antimicrobial properties are effective in destroying or inhibiting virus cells such as COVID-19.

As used herein, the term "basketball goal" refers to a basketball goal system that includes at least a rim and a basketball net. Those of ordinary skill in the art will recognize based on the disclosure herein that a basketball goal can also include a backboard, an extension arm/boom, pole, weighted base and or other support structure that secures the combination of the rim and the backboard at the desired location and elevation.

As used herein, the term "string" refers to any material that has a length dimension that is larger than its width dimension such that when used to construct a basketball net, the net includes a series of openings where the openings provide the majority of the surface area of an overall shape defined by the net when hung from a rim. Those of ordinary skill in the art will recognize based on the disclosure herein that a string can include a single homogenous material, a woven material, extruded or printed material, and further, that a string can include natural material(s), synthetic material(s) or a combination of natural and synthetic materials. Further, those of ordinary skill in the art will recognize based on the disclosure herein that a string can include a cord of material with a circular cross section but may also include materials that have an overall square or rectangular cross-sectional shape. That is, a string need not define a cylindrical shape. Accordingly, material can be manufactured in sheets including a series of openings defined by "strings" of material where the openings provide the majority of the surface area of an overall shape defined by the net when hung from a rim. Further, a basketball net can be manufactured in solid sheets that are stamped or die cut to form a series of openings defined by "strings" of material where the openings provide the majority of the surface area of an overall shape defined by the net when hung from a rim. In various approaches, the "sheets" of material can include fabric.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
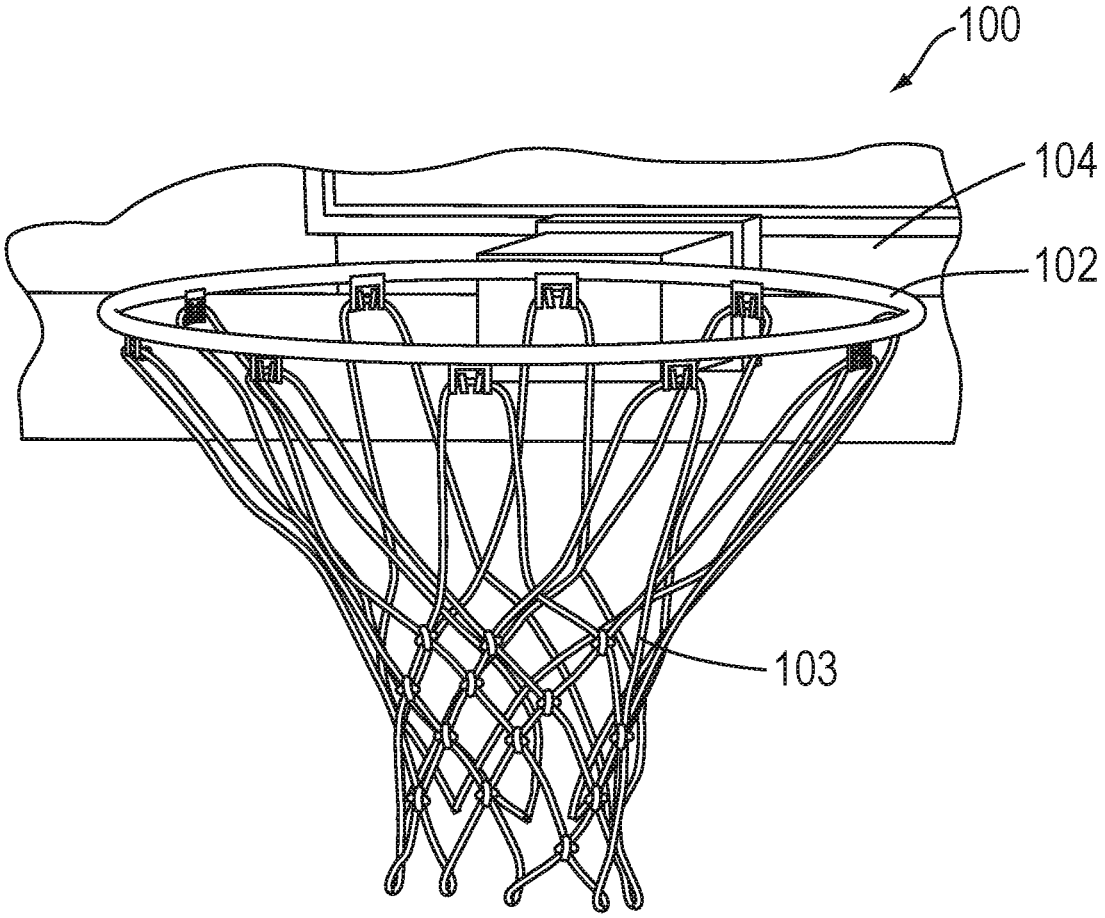
FIG. 1 PRIOR ART
FIG. 1 illustrates a basketball goal of the prior art.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

Figure 2:
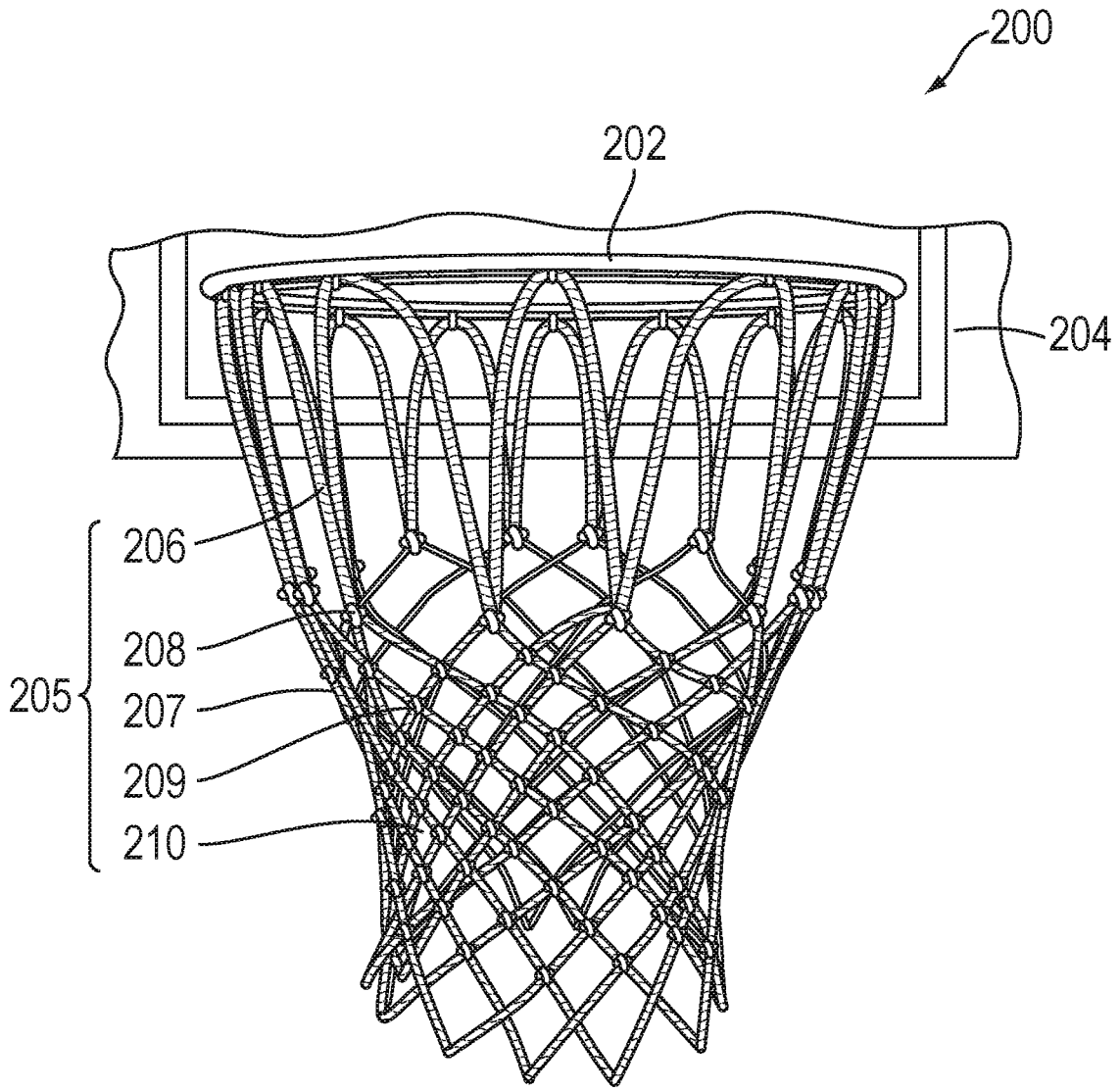
FIG. 2 illustrates a basketball goal including a basketball net in accordance with a first embodiment.

Referring to FIG. 2, a basketball goal 200 including a net 205 is illustrated in accordance with a first embodiment. The basketball goal 200 also includes a rim 202 and a backboard 204. The rim 202 includes a flange that is used to secure the rim 202 to the backboard 204. The rim 202 also includes a series of hooks evenly spaced at locations around the rim. Various types of support structure (not illustrated) can be employed to secure the basketball goal 200 at the desired location and height.

According to the illustrated embodiment, the net 205 includes a first plurality of strings 206, a second plurality of strings 207, a first plurality of knots 208, a second plurality of knots and a plurality of openings 210. According to the illustrated embodiment, the first plurality of strings 206 are located in an upper region of the net 205. The first plurality of strings 206 are referred to as loops and the loops are employed to attach the net 205 to the rim 202. According to these embodiments, the second plurality of strings 207 are located in the region below the first plurality of strings 206. The second plurality of strings 207 are referred to as mesh. The loops are attached to the mesh with the first plurality of knots 208. The second plurality of strings 207 are connected to one another by the second plurality of knots 209 to form the opening 210. The openings 210 generally have an overall triangle or diamond-like shape with the knots 208, 209 located at some of the attachment points of the strings 206. The loops are employed to attach the top of the net 205 to the rim 202 using the hooks. As used herein, the term "loop region" refers to the portions of the net 205 between the attachment to the rim 202 and the first plurality of knots 208. As used herein, the term "mesh region" refers to the portions of the net 205 from the first plurality of knots 208 to the bottom of the net 205.

With the net 205 secured to the rim 202 and hanging in a relaxed state, the net 205 has an overall conical shape. That is the diameter of a central opening defined by the top of the net 205 is substantially the same as the inside diameter of the opening defined by the rim 202. In each case, the diameter is slightly larger than the outside diameter of a basketball. However, the upper half of the net 205 tapers inward such that the central and lower regions of the net 205 (i.e., the mesh region) define a central opening in the net that is smaller in diameter than the opening at the top of the net 205. Consequently, the central opening in the bottom half of the net 205 is smaller than the outside diameter of the basketball. According to one embodiment, the net 205 is from 15" to 18" in length and the string 206 is manufactured from a woven material with a thread count of between 30 and 120 threads.

The construction of the net 205 provides it with a dynamic response as a basketball falls through it. In particular, the openings 205 are temporarily deformed as a basketball drops through the rim 202 and into the net 205. The deformation temporarily shortens the overall length of the net 205 and temporarily increases the inside diameter of the central opening in the central and lower regions of the net 205. As a result, the descent of the basketball is slowed and its direction of travel is affected to reduce the distance that the ball travels from the basketball goal 200 when it exits the net 205.

According to the illustrated embodiment, the net 205 has a conventional appearance but has moisture wicking, moisture absorbent, anti-odor and/or antimicrobial properties. According to one embodiment, the string 206 includes a conventional basketball net 205 manufactured from woven fibers, for example, cotton, polyester or other materials. According to some embodiments, the material of construction is selected because the material has moisture wicking properties. The net 205 can be treated with an antimicrobial chemical or chemical compound. According to some embodiments, the antimicrobial compound is sprayed onto the surface of the net 205. According to other embodiments, the net 205 is dipped in an antimicrobial solution. According to other embodiments, the net 205 is manufactured from a high-performance material with antimicrobial properties inherent in the material. For example, the thread or yarn used to weave the strings 206 can include inherent antimicrobial properties while also promoting moisture movement and/or moisture absorption. According to further embodiments, the strings 206 can include multiple individual woven strings that are woven together or secured within another sheath of fiber or another material, for example, a moisture wicking material. In one embodiment where multiple individual strings are separately woven and then sheathed or otherwise bound together, the individual strings include the same moisture wicking, moisture absorbent, anti-odor and/or antimicrobial properties. According to another embodiment, each of the individual strings provides a subset of properties desired in the overall net 205. For example, a first type of string can include antimicrobial properties. A second type of string can include moisture wicking and/or moisture absorbing properties. In this embodiment, the first type of string and the second type of string are woven, sheathed, bound or otherwise secured together to provide the overall net 205 with each of the desired properties.

Depending on the embodiment, the antimicrobial properties can be achieved using compounds or materials that include silver or copper. According to another embodiments, the antimicrobial properties are provided by soaking the net 205 in a solution that has a high ethyl alcohol content. According to one embodiment, the solution includes at least 60% ethyl alcohol. According to one embodiment, the net 205 is treated with a gel includes that includes at least 60% ethyl alcohol. The use of ethyl alcohol is suitable where the dampness of the net 205 is not a concern. The quick drying nature of ethyl alcohol is also advantageous because the surface of the basketball can be cleaned without leaving moisture on the ball for any length of time.

According to further embodiments, only strings 206 in a limited region of the net 205 have the moisture wicking, moisture absorbing and/or antimicrobial properties. For example, strings 206 in either or both of the central and lower regions of the net 205 include high-performance materials with any one or any combination of moisture wicking, moisture absorbing and/or antimicrobial properties. In one embodiment, conventional materials are employed for the strings in the upper half of the net 205 and the high-performance materials form the lower half of the net 205. The high-performance strings can be attached to the lower ends of the conventional upper strings using knots, by splicing, looping and/or applying adhesive.

In yet another embodiment, an added set of strings is added to either or both of the central and the lower regions of the net 205. In this embodiment, the added set of strings is manufactured from high-performance materials with any one or any combination of moisture wicking, moisture absorbing and/or antimicrobial properties. The added set of strings can be attached to the strings 206 at one end or both ends of the added string. In the first approach, the added strings dangle downward from their point of attachment with the opposite end free to move about as the ball drops through the net 205. In either approach, the added set of strings is located on an inside of the net 205 to ensure that the added strings make contact with the ball.

When in use, the net 205 operates to wipe the surface of the basketball each time a shot drops through the net 205. In this manner, the antimicrobial and moisture wicking properties are applied to various parts of the exterior surface of the ball to clean and dry the ball in a manner that removes sweat and removes or inhibits the growth of microorganisms.

Figure 3:
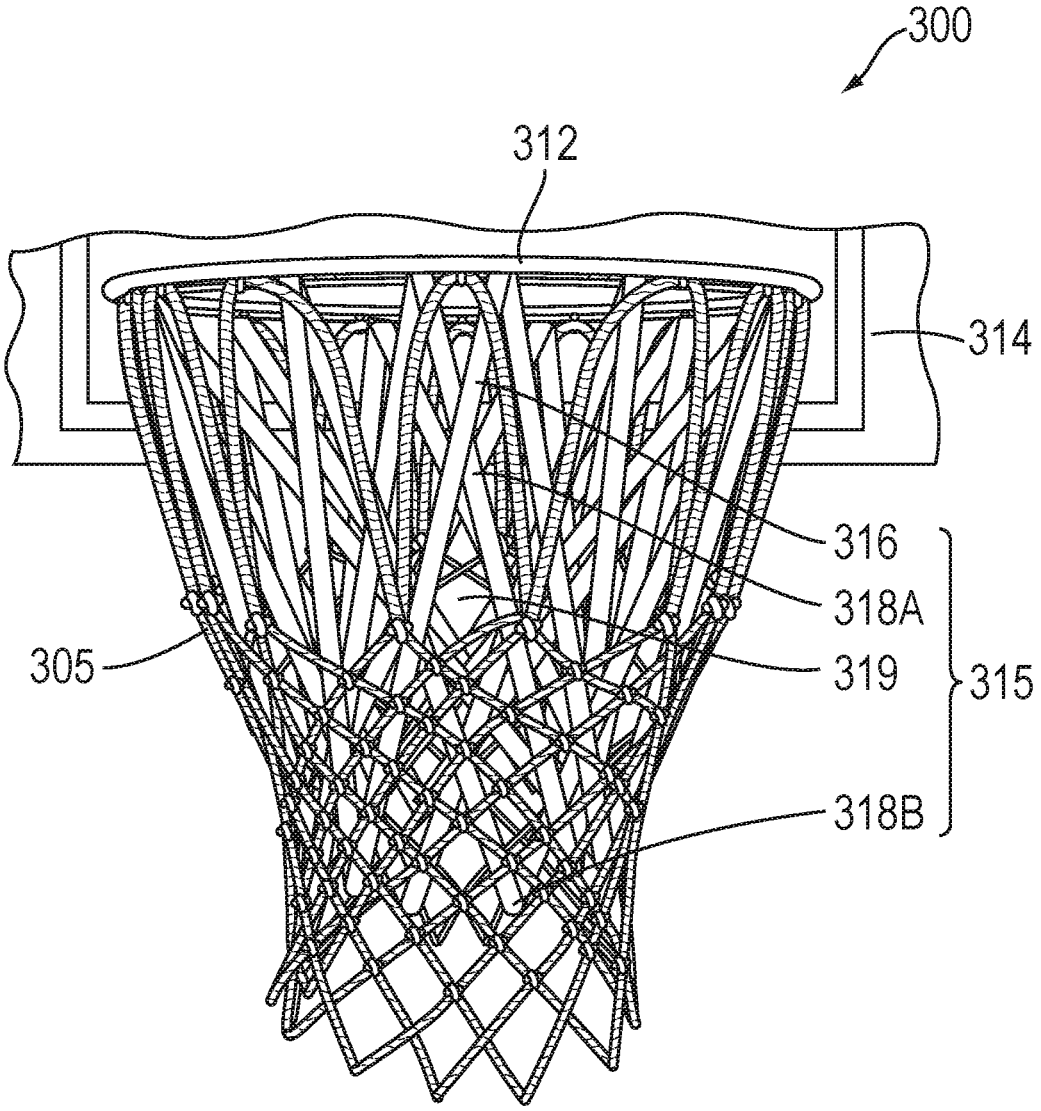
FIG. 3 illustrates a basketball goal including a basketball net in accordance with a second embodiment.

Referring now to FIG. 3, a basketball goal 300 including an outer basketball net 305 and an inner basketball net 315 is illustrated in accordance with a second embodiment. The basketball goal 300 also includes a rim 312 and a backboard 314. The rim 312 includes a flange that is used to secure the rim 312 to the backboard 314. The rim 312 also includes a series of hooks evenly spaced at locations around the rim 312. Various types of support structure (not illustrated) can be employed to secure the basketball goal 300 at the desired location and height.

According to the illustrated embodiment, the inner net 315 includes a plurality of strings 316, a plurality of attachment points 318A, 318B, 318C and a plurality of openings 319. The strings 316 are connected to one another at the attachment points 318A, 318B, 318C to form the opening 319. The openings 319 in the regions between the strings 316 generally have an overall triangle or diamond-like shape. The top of the inner net 315 is attached to the rim 312 using the hooks. According to the illustrated embodiment, the outer net 305 and the inner net 315 are attached to the rim using the same set of hooks. With the net 315 secured to the rim 312 and hanging in a relaxed state, the openings 319 located in the upper region of the net 315 are larger in size than the openings 319 located in the lower half of the net. For example, the openings 319 at the top of the net 315 that are secured to the rim 312 provide the largest openings 319. In addition, the inner net 315 has a generally conical overall shape when hanging from the rim 312 in a relaxed state. That is, the diameter of a central opening defined by the top of the inner net 315 is substantially the same as the inside diameter of the opening defined by the rim 312. In each case, the diameter is slightly larger than the outside diameter of a basketball. However, the upper half of the inner net 315 tapers inward such that the central and lower regions of the inner net 315 define a central opening in the net that is smaller in diameter than the opening at the top of the inner net 315. Consequently, the central opening in the bottom half of the inner net 315 is smaller than the outside diameter of the basketball. The construction of the inner net 315 provides it with a dynamic response as a basketball passes through it as described above with reference to the net 205.

The inner net 315 can be manufactured from a high-performance material with moisture wicking, moisture absorbent, anti-odor and/or antimicrobial properties. The antimicrobial, moisture wicking, moisture absorbent and/or anti-odor properties can be provided using any of the approaches described above with reference to the net 205 illustrated and described with reference to FIG. 2. For example, the antimicrobial properties can be provided by treating the material of the inner net 315 with an antimicrobial compound. According to some embodiments, an antimicrobial compound is sprayed onto the surface of the inner net 315, that is, sprayed on the surface of the strings 316. According to other embodiments, the inner net 315 is dipped in an antimicrobial solution to provide the strings 316 with antimicrobial properties. According to other embodiments, the strings 316 included in the inner net 315 are manufactured from a high-performance material with antimicrobial properties inherent in the material of manufacture. According to any of the preceding embodiments, the inner net 315 includes strings 316 manufactured from woven synthetic fibers. According to some embodiments, the tightness of the weave is adjusted to improve the moisture wicking and/or antimicrobial properties of the inner net 315. For example, a looser weave can provide increased surface area for the application of an antimicrobial compound by increasing the available surface area of the string 316. A looser weave may also increase the moisture wicking capabilities of the strings 316. According to other embodiments, a tighter weave is employed to provide a greater mass of material available to wick and absorb moisture from the surface of the ball.

The attachment points 318A, 318B, 318C are employed to secure different segments of the string 316 to one another. This maintains the overall shape of the inner net 315 through repeated use. For example, the inside diameter of the inner net 315 and overall conical shape of the net 315 are maintained with the different segments of the string 316 secured to one another at the attachment points 318A, 318B, 318C. Depending on the embodiment, the attachment points 318A, 318B, 318C can include knots, stitching, or combinations of the preceding to secure the different strings 316 to one another. Further, as described with reference to FIG. 5, the thickness of the material in the region of the attachments can be increased to increase the contact pressure applied to the basketball as it drops through the inner net 315. In various embodiments, this feature aids in removing sweat from the basketball as it passes through the inner net 315 while also aiding in the cleaning of the outer surface of the basketball to remove germs.

According to the illustrated embodiment, the inner net 315 has an overall conical shape when hanging from the rim 312. However, the length and the average diameter of the inner net 315 are smaller than the length and the average diameter of the outer net 305. This allows the inner net 315 to be received within the outer net 305.

In various embodiments, the outer net 305 is constructed of a traditional and standard basketball net made of material such as cotton or polyester for indoor and outdoor play, or chain link metal for outdoor play. According to some embodiments, the inner net 315 is sewed or otherwise attached to the outer net 305 at selected locations. This close integration of the inner net 315 with the outer net 305 can assist in giving the basketball goal 300 a traditional appearance. According to another aspect, the manner that the inner and outer nets are sewed together allows the combined net to look and function like a standard basketball net, while also offering moisture wicking/absorbing and antimicrobial properties.

According to still further embodiments, the inner net 315 can be installed and removed independent of the outer net 305. These embodiments provide flexibility that allows an athlete or a group of athletes to arrive at a basketball court (for example, a public basketball court) with a moisture wicking/absorbing and antimicrobial inner net 315. The inner net 315 can be temporarily secured to the rim 312 in a conventional manner to locate the inner net 315 within a conventional outer net 305. The athletes can participate in a practice or game with the inner net 315 installed to improve their performance and player safety. Specifically, the moisture wicking aspects of the inner net 315 delivers a drier ball to the athletes after a successful shot. The antimicrobial aspect of the inner net 315 reduces the risk of transmitting infection between athletes via the ball. The owner of the inner net 315 can remove the inner net 315 following a completion of the practice or game and while leaving the conventional inner net 305 in place for continued use by other athletes.

Regardless of whether or not the inner net 315 and the outer net 305 are permanently attached to one another, the netting can be removed to allow the inner net 315 to be removed for a reapplication of an antimicrobial compound. For example, an application of the antimicrobial compound by spraying the compound onto the surface of the inner net 315 or dipping the inner net 315 in an antimicrobial solution or gel.

Figure 4:
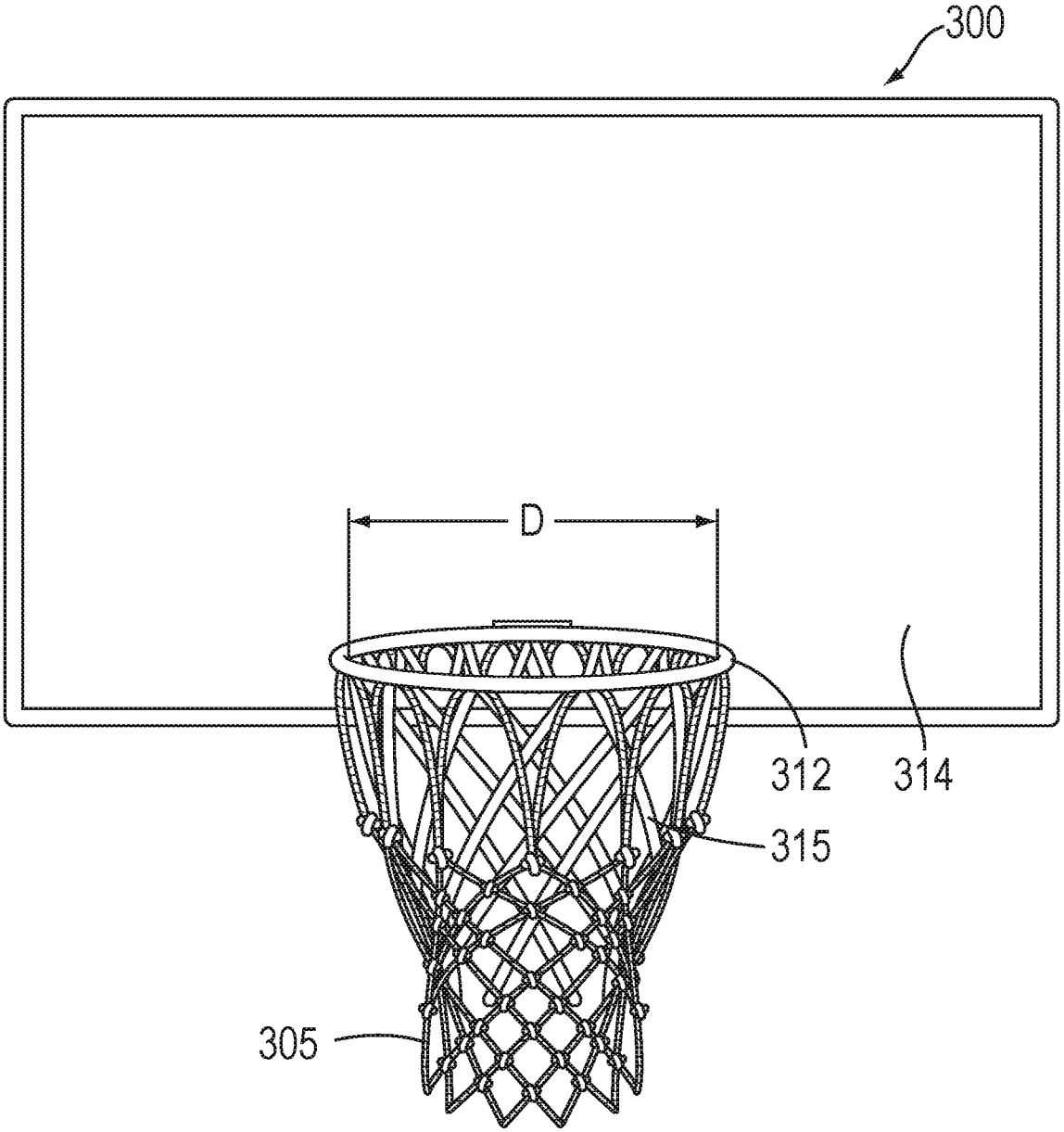
FIG. 4 illustrates another view of the basketball goal of FIG. 3.

Referring now to FIG. 4, a front view of a basketball goal 300 in accordance with the second embodiment is shown. FIG. 4 illustrates the outer net 305, the rim 312, the backboard 314 and the inner net 315. FIG. 4 also illustrates an inside diameter D of the rim 312. As is apparent in FIG. 4, both the inner diameter of the inner net 315 and the inner diameter of the outer net 305 are substantially equal to the inner diameter D at the point of attachment of the nets 305, 315 to the rim 312.

Figure 5:
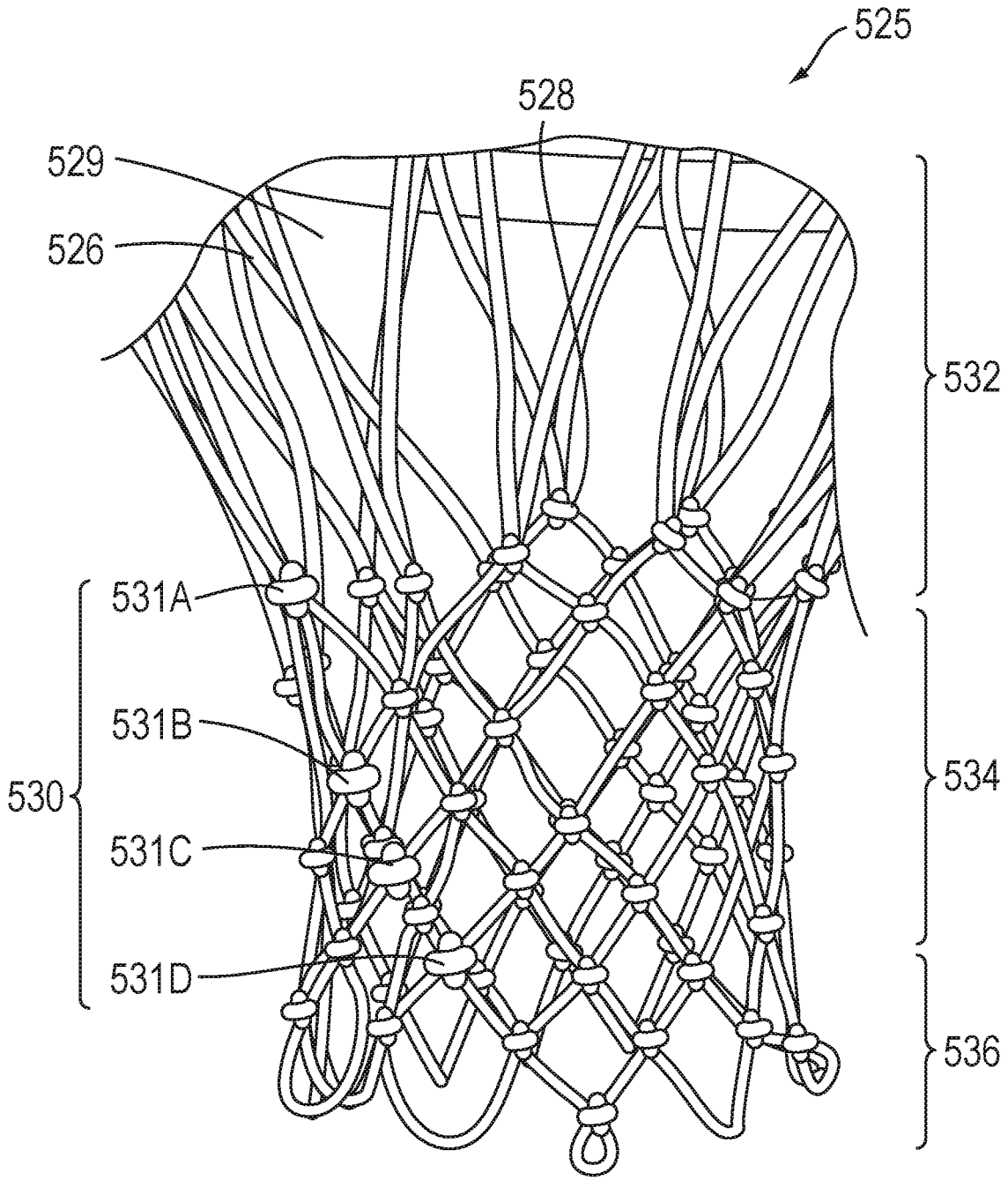
FIG. 5 illustrates a basketball net in accordance with one embodiment.

Some embodiments include a net that has regions of having an increased thickness to increase the contact pressure applied by the net on the surface of the basketball. Referring now to FIG. 5, an embodiment of a basketball goal includes a basketball net 525 including strings 526, a first set of knots 528 and a second set of knots 530. The net 525 is constructed with the string 526 and knots 528, 530 to define a series of openings 529 in the manner generally described above with reference to FIGS. 2 and 3. The overall conical shape of the net 525 includes an upper region 532, a central region 534 and a lower region 536. The second set of knots 530 include a plurality of knots 531 that include high-performance materials with any one or any combination of moisture wicking, moisture absorbing, anti-odor and/or antimicrobial properties.

In various embodiments, the plurality of knots 531 have a larger outside diameter than a conventional knot. The larger diameter can be a result of an addition of material that includes any of moisture wicking, moisture absorbing, anti-odor and/or antimicrobial properties. These properties can be provided in the manner described above regarding the nets 205 and 315. Further depending on the embodiment, the added diameter can be achieved by "double knotting" the connection points between the strings or adding additional material to wrap on an exterior of an otherwise conventionally sized knot, for example, the knots 528. According to one embodiment, the net 525 is a conventional net manufactured from woven fibers, for example, cotton, polyester or other materials. In this embodiment, the net 525 may only have moisture wicking, moisture absorbing, anti-odor and/or antimicrobial properties at the plurality of knots 531. According to another embodiment, the entire net is manufactured from a high-performance material with moisture wicking, moisture absorbing, anti-odor and/or antimicrobial properties. In either embodiment, a high-performance material is be wrapped around the conventional knots as an added layer to create a denser surface area that will allow additional contact and friction with the ball as it passes through the net.

According to the illustrated embodiment, the plurality of knots 530 includes a first knot 531A, a second knot 531B, a third knot 531C and a fourth knot 531D. While not illustrated, these larger diameter knots can be located for 360 degrees about the net 525. In the illustrated embodiment, the upper region 532 does not include any large diameter knots 530. The lower region 536 also does not include any large diameter knots 530. Instead, the second set of knots 530 are disposed in the central region 534. The central region 534 has the smallest inside diameter. Accordingly, the maximum amount of contact and contact-pressure between the net 525 and the basketball is available in the central region 534. With the second set of knots 530 located in the center region 534, the basketball is subject to the maximum amount of wiping pressure as the ball drops through the net 525.

Figure 6A:
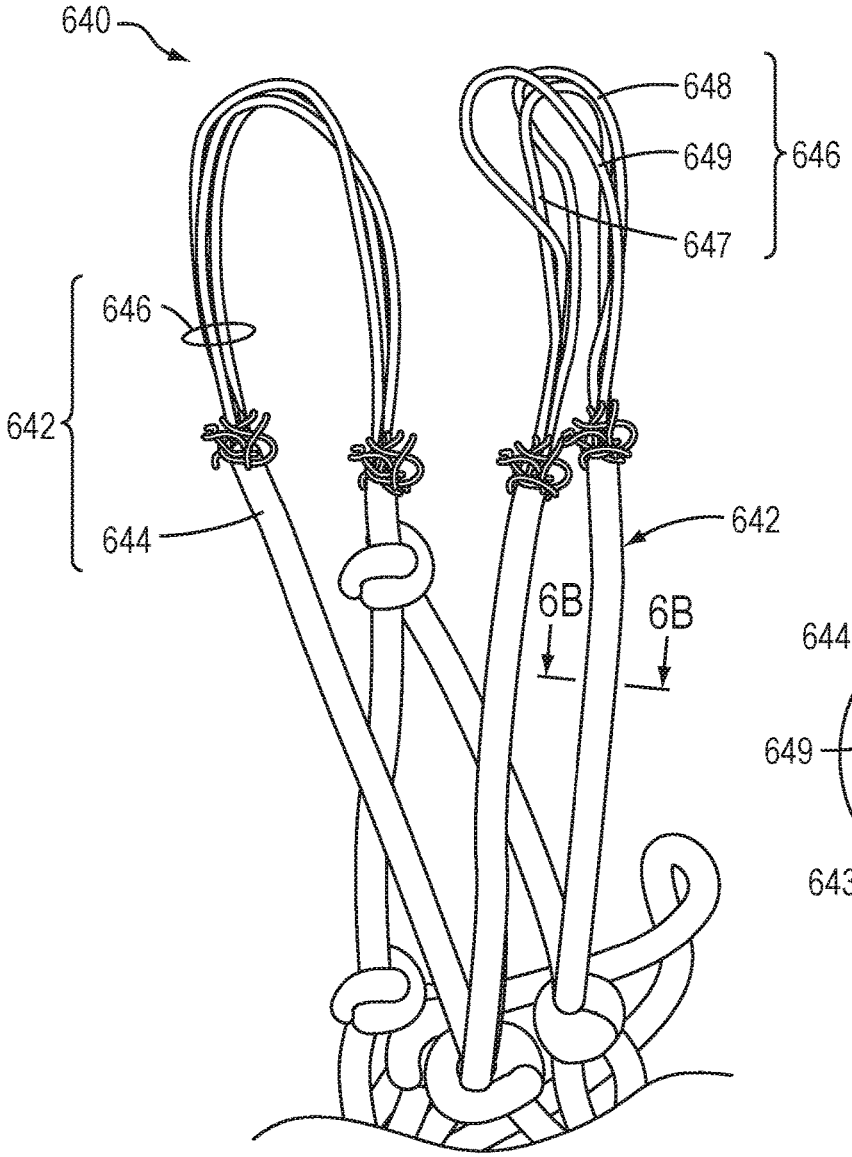
FIG. 6A illustrates a basketball net in accordance with a further embodiment.
Figure 6B:
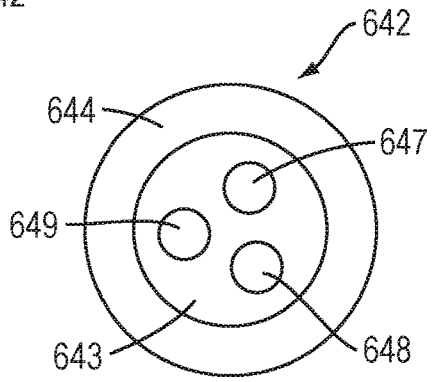
FIG. 6B illustrates a cross-sectional view of a string included in the basketball net illustrated in FIG. 6A.

Referring now to FIGS. 6A and 6B, details of construction of a basketball net 640 is illustrated in accordance with various embodiments. The basketball net 640 is constructed with string 642 that includes an outer cord 644 and an inner cord 646. Depending on the embodiment, the string 642 can be employed to construct any of: the net 205 illustrated and described with reference to FIG. 2; the outer basketball net 305 and/or the inner basketball net 315 described with reference to FIG. 3; the net 525 illustrated and described with reference to FIG. 5. As will be apparent to those of ordinary skill in the art in view of the disclosure provided herein, the string 642 can be employed to construct other types of basketball nets or other nets for athletic equipment in various alternate embodiments. According to various embodiments, either or both of the outer cord 644 and the inner cord 646 include antimicrobial and moisture wicking characteristics. In these embodiments, the construction of the strings employed in the basketball net provide a layered construction with an outer layer provided by the outer cord 644 and an inner layer provided by the inner cord 646. Applicants find that the use of antimicrobial, moisture wicking fiber in both the inner layer and the outer layer provides a highly effective approach to reduce the moisture and microorganisms that are otherwise found on the exterior surface of a basketball when in use.

According to the illustrated embodiment, the inner cord 646 includes a plurality of cords including a first cord 647, a second cord 648 and a third cord 649. In various embodiments, the materials and construction of the first cord 646, the second cord 648 and the third cord 649 are selected together such that the inner cord 646 provides antimicrobial and moisture wicking characteristics in combination with the strength and durability required of a basketball net. According to one embodiment, the outer cord 644 is manufactured of an antimicrobial moisture wicking yarn that is braided into a cord to form a wall that defines a hollow central region running axially along the longitudinal axis of the cord. For example, FIG. 6B provides a cross-sectional view of the string 642. The cross-sectional view illustrates a hollow central region 643 formed within the outer cord 644. According to the illustrated embodiment, each of the first cord 647, the second cord 648 and the third cord 649 are located axially within the hollow central region 643. In various embodiments, each of the outer cord 644 and the inner cord 646 are flexible. As a result, the shape of the hollow central region can change dynamically when in use. Similarly, the three inner cords 647, 648, 649 can flex within the hollow central region 643 and may contact one another and/or the inside region of the wall formed by the outer cord 644. According to one embodiment, an AEROSILVER antimicrobial moisture wicking yarn is employed in fabricating each of the outer cord 644 and the inner cord 646.

According to various embodiments, the outer cord 644 is manufactured from an antimicrobial moisture wicking synthetic yarn, for example, a polyester yarn. In some embodiments, the yarn includes nanoparticles within the volume of the yarn. In further embodiments, the nanoparticles can include silver, copper, a combination of the preceding or a combination of any of the preceding and nanoparticles including other materials. In some embodiments, the yarn is manufactured such that nanoparticles are distributed substantially uniformly within the yarn. In one embodiment, the outer cord 644 is manufactured from silver nanoparticle woven polyester fiber.

Applicants find that the overall strength, antimicrobial and moisture wicking performance of the net 640 is improved when the inner cords 647, 648, 649 provide a combination of these features. Further, the use of a plurality of inner cords can improve both the performance and the manufacturability of the net 640. According to some embodiments, the first cord 647 is fabricated entirely from an antimicrobial moisture wicking yarns. In one embodiment, the first cord 647 can include a plurality of yarns including antimicrobial moisture wicking properties. According to one embodiment, the antimicrobial moisture wicking yarn employed to fabricate the first cord 467 includes a linear density of 300 Denier or greater. According to another embodiment, the first cord 647 includes four yarns having the same denier and the same antimicrobial and moisture wicking properties.

According to some embodiments, the second cord 648 includes both an antimicrobial moisture wicking yarn and a monofiber yarn. For example, the second cord 648 can include a combination of yarns including antimicrobial moisture wicking yarn and a monofiber yarn braided together.

According to one embodiment, the third cord 649 is manufactured as a synthetic monofiber, for example, polyethylene that does not include antimicrobial or moisture wicking features. In a further embodiment, a plurality of polyethylene monofibers are included in the third cord 649. According to one embodiment, twenty individual synthetic monofibers are included in the third cord 649.

An inner cord 646 manufactured with the above-described embodiments of the first cord 647, the second cord 648, and the third cord 649 provides a net 640 with that is antimicrobial and moisture wicking with the strength and durability for extended use while also delivering a net material that quickly absorbs moisture to allow the net 640 to remain dry to the touch during use with a basketball that may be covered in sweat.

In additional embodiments, the materials of construction of the first cord 647, the second cord 648, and the third cord 649, respectively, can be varied to increase selected characteristics of the basketball net 640. For example, the antimicrobial and moisture wicking characteristics can be increased by including antimicrobial and moisture wicking fibers in each of the three cords 647, 648, 649. According to one embodiment, each of the first cord 647, the second cord 648, and the third cord 649, respectively, are manufactured using only antimicrobial and moisture wicking yarns. In other examples, the strength and durability of the basketball net 640 are increased by including monofiber in each of the three cords 647, 648, 649. According to one embodiment, each of the first cord 647, the second cord 648, and the third cord 649, respectively, are manufactured using only monofiber. In yet another embodiment, each of the first cord 647, the second cord 648, and the third cord 649, respectively, include both an antimicrobial moisture wicking yarn and a monofiber yarn. For example, each of the three cords 647, 648, 649 can include a combination of yarns including antimicrobial moisture wicking yarn and a monofiber yarn braided together.

According to some embodiments, the first plurality of strings 206 is constructed differently than the second plurality of strings 207. These embodiments can be employed to increase the strength and durability of the loop region of the net (that is, the upper region of the net that is attached directly to the rim) relative to the mesh (or lower) region of the net. For example, the first plurality of strings 206 can include an outer cord of antimicrobial, moisture wicking fiber, as described above with reference to the outer cord 644, and inner cords where antimicrobial, moisture wicking fiber is absent. In one embodiment, the first plurality of strings 206 are constructed using three inner cords located within a hollow central region formed by the outer cord where each of the three inner cords only includes monofiber yarn.

The antimicrobial and moisture wicking fibers and yarns described herein are silver infused. For example, embodiments of the basketball net 205, 305, 525 and 640 include a silver nanoparticle polyester fiber can be manufactured via a melted blend. In addition to a silver nanoparticle resin, the blend can include one or more of a UV stabilizer, antioxidant, nitrogen oxide gas yellowing inhibitor, adhesion promoter, chlorine remover, a quencher or other elements either alone or in combination with one or more of the preceding. According to some embodiments, these additives can be added to the melted blend along with the antimicrobial silver nanoparticle resin.

Applicants have found that the available antimicrobial moisture wicking yarns may not be strong enough for use in a basketball net. For example, Applicants find that a 150 denier antimicrobial moisture wicking yarn is on its own unsuitable for constructing a basketball net. According to some embodiments, a conventional antimicrobial moisture wicking yarn (for example, a conventional yarn manufactured from AEROSILVER) is covered with another antimicrobial moisture wicking yarn to increase the linear density and the strength of the yarn. This covered antimicrobial moisture wicking yarn is then employed in manufacture of the outer cord 644. The antimicrobial moisture wicking covered yarn can also be employed in the manufacture of the first cord 647 and the second cord 648. According to one embodiment, the antimicrobial moisture wicking yarn employed in constructing the basketball net 640 includes a first antimicrobial moisture wicking yarn having a first denier and a first thread count covered by a second antimicrobial moisture wicking yarn having a second denier and a second thread count. In various embodiments, the first antimicrobial moisture wicking yarn and the second antimicrobial moisture wicking yarn have the same denier and the same thread count as one another. According to these embodiments, the antimicrobial moisture wicking yarn constructed by covering a first yarn with a second yarn produces an antimicrobial moisture wicking yarn having twice the denier and twice the thread count of either yarn alone. As used herein, the term "cover," "covering" or "covered" when referring to the construction of a yarn means wrapping at least one yarn around another.

While the preceding describes various embodiments including one or more materials employed in combination to construct the basketball net 640, other combinations of manufacturing techniques and materials can be employed in some embodiments. For example, in some embodiments, an antimicrobial solution can be applied to a basketball net. The preceding includes embodiments in which the antimicrobial spray is applied to a net that includes antimicrobial fibers and also embodiments in which the antimicrobial spray is applied to a basketball net having a conventional construction. According to one embodiment, an emulsion is sprayed onto a silver-infused fabric employed to construct a basketball net. Further, the embodiments described with reference to the basketball net 640 can include different variations to provide the desired combination of antimicrobial, moisture wicking durable performance. In one embodiment, the outer cord 644 includes anti-microbial moisture wicking fibers but the inner cord 646 does not. In this embodiment, the inner cord 646 can be manufactured solely of monofiber to maximize the strength and durability of the net 640.

In another embodiment, the inner cord 646 includes anti-microbial moisture wicking fibers but the outer cord 644 does not. In this embodiment, the net construction may improve the antimicrobial moisture wicking properties of the net when compared with a conventional net while still providing a durable long lasting product.

In yet another embodiment, a plurality of antimicrobial pegs are located within the hollow central region 643 of the net 640. Depending on the embodiment, the "pegs" can include solid or tubular cylindrical elements with antimicrobial properties. The pegs can be provided in various lengths to allow use throughout different locations in either or both of the loop region and the mesh region of the net.

When in use, the net 640 wipes the surface of the basketball each time a shot drops through the net 640. The outer cord 644 provides a first layer to wick up the moisture wiped off the surface of the basketball. In this manner, the antimicrobial and moisture wicking properties are applied to various parts of the exterior surface of the ball to clean and dry the ball in a manner that removes sweat and removes or inhibits the growth of microorganisms. According to some embodiments, the outer cord 644 including antimicrobial properties also captures germs, viruses and other microbes carried by the absorbed moisture. In addition, the inner cord 646 provides a second layer to wick the moisture from the outer cord 644 to an interior region of the cord. This further reduces the likelihood that an athlete will contact moisture that includes microorganisms. Applicant finds that the use of moisture wicking antimicrobial fiber in multiple layers removes moisture from the exterior of the net 640 so that it is almost immediately dry to the touch when the outer surface of the net becomes wet.

Given the size of the sports memorabilia market, there is significant interest in the marketplace for unique tangible items having a direct association with a sporting event or athlete. Historically, these items are created organically, for example, a folding chair that was removed from an arena or other venue prior to the renovation or demolition of the venue, an item of athletic equipment that was used during an event or a photograph that captures a defining moment of a game or other sporting event.

In today's world, the branding of teams and athletes is a huge part of creating value in any item of sports memorabilia. FIGS. 7-13 illustrate various durable, removable labels that can include custom branding and be secured to a basketball net to create an item of sports memorabilia. According to some embodiments, the removable labels include a brand for marketing purposes. That is, the labels can promote a brand that is displayed for the period that the label is affixed to the net. A basketball net is the focal point for fans whether they are in attendance or viewing the game via television/video. Consequently, marketing indicia included on a label secured to the front of the net will receive repeated views by the fans. Various embodiments allow for durable labels that are easily and securely fastened to a basketball net. Further, any form of indicia can be printed on the front surface of the label. These can include alpha and numeric text as well as art work. According to one embodiment, the logo or other indicia are applied to the front surface of the label using heat transfer technology. These embodiments are also constructed so that the label does not interfere with game play and can quickly be removed by hand without using any tools. The labels are also constructed to securely attach to the net such that the label does not pose a risk of injury to the players while also not interfering with the performance of the net.

Figure 7A:
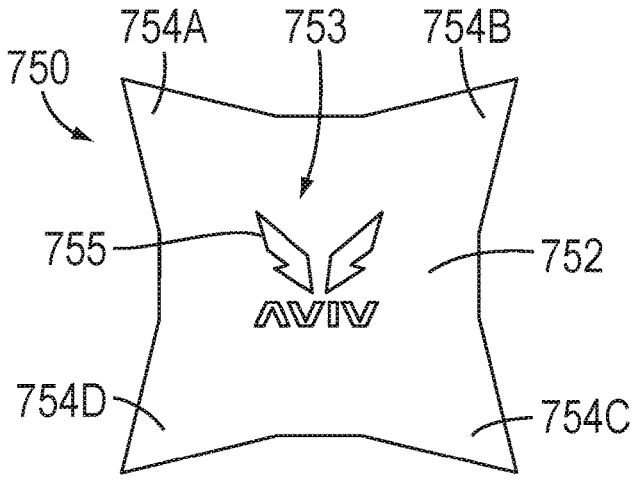
FIGS. 7A-7E illustrate a label in accordance with a first embodiment.

Referring now to FIGS. 7A-7D, a label 750 is illustrated in accordance with a first embodiment. FIG. 7A illustrates a front view of the label 750. The label 750 includes a body 752, a front surface 753 and a plurality of tabs 754A-754D. Each of the plurality of tabs 754A, 754B, 754C and 754D extend radially outward from a respective corner of the body 752. A logo 755 is centrally located on the front surface 753. According to some embodiments, the label 750 is manufactured of a synthetic material including elastane, for example, Lycra or Spandex synthetic fiber.

Figure 7B:
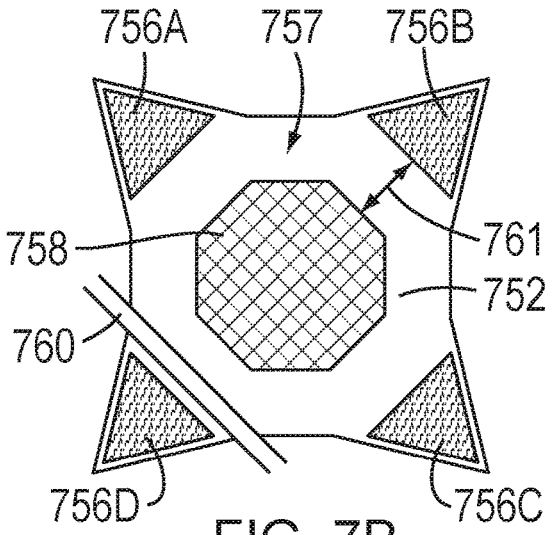

FIG. 7B illustrates a rear view of the label 750. In various embodiments, the rear side of the plurality of tabs 745A-754D include an adhesive. The rear side includes a rear surface 757 and a plurality of adhesive regions 756A-756D each located on the rear surface of one of the plurality of tabs 745A-754D, respectively. The label 750 also includes a central adhesive region 758 located on the rear surface 757. An adhesive-free region 761 exists between each of the adhesive regions 756A-756D, respectively, and the central adhesive region 758. In some embodiments, the surface area of the adhesive free region 761 is controlled by selecting a desired radius of the central adhesive region 758 and a radial length of each of the plurality of adhesive regions 756A-756D. A proper selection of these dimension provides sufficient space to locate a string 760 included in a basketball net. In particular, the dimensions are established to allow the string 760 to be securely enclosed when the tabs 745A-745D are folded rearward while avoiding contact between the string 760 and either the central adhesive region 758 or any of the plurality of adhesive regions 756A-756D. Applicant finds that this prevents damage to the string 760 that would otherwise occur.

Figure 7C:
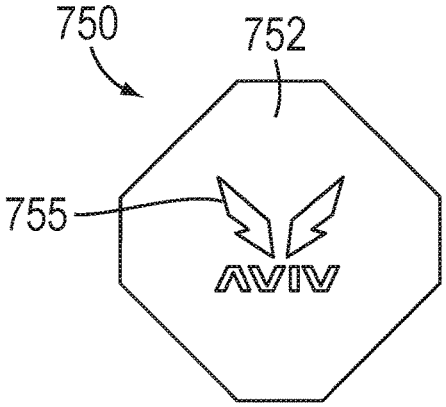

FIG. 7C illustrates a front view of the label 750 in a configuration where the plurality of tabs 754A-754D are folded rearward to place each of the plurality of tabs 754A-754D, respectively, in contact with the rear of the label 750 as is illustrated and described in greater detail below with reference to FIG. 7E. According to this embodiment, the rearward fold allows each of the plurality of adhesive regions 756A-756D to be placed in contact with the central adhesive region 758. In various embodiments, the bond formed between the each of the respective plurality of adhesive regions 756A-756D and the central adhesive region 758 is secure but temporary. According to various embodiments, VELCRO hook and loop style fastening material is employed for each of the plurality of adhesive regions 756A-756D and the central adhesive region 758. In various embodiments, other forms of adhesive can be employed if they will stay securely attached when subject to typical wear and tear that a basketball net is subject to while also providing a releasable attachment. In various embodiments, the adhesive strength and manner of fastening allow the label to be removed from the net by hand without the use of tools. These alternative fastening means can include snaps, ties, other mechanical fastening means, or glue that provides a releasable bond.

Figure 7D:
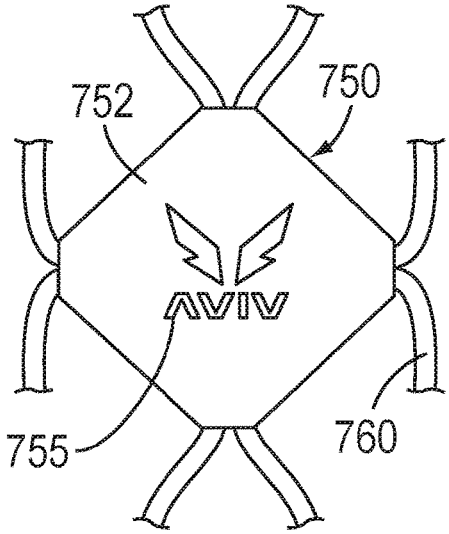

FIG. 7D illustrates a front view of the label 750 with the label secured to the strings 760 included in a basketball net. When attached as illustrated the front surface 753 of the body 752 is unobstructed when viewed from the from of the net. This clearly displays the logo 755 when attached to the net. Further, the manner of attachment provides the label with a secure attachment at each of four corners.

Figure 7E:
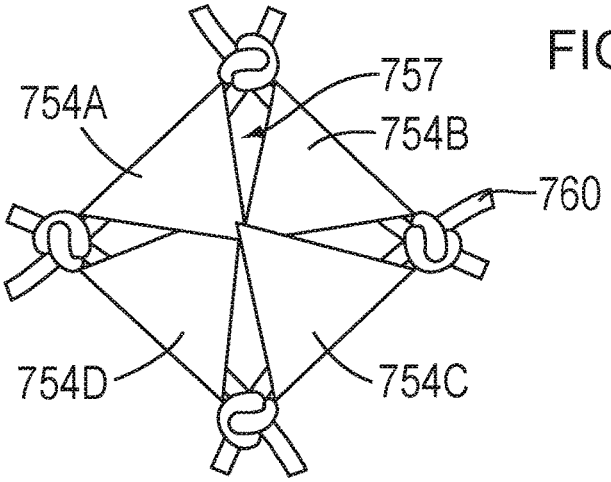

As illustrated in FIG. 7E, when in operation, each of the plurality of tabs 754A-754D is folded rearward toward the rear surface 757 to wrap around the string 760. Each of the plurality of tabs 754A-754D is pressed into engagement with the body 752. This presses each of the respective adhesive regions included in the plurality of adhesive regions 756A-756D into engagement with the central adhesive region 758. Thus, securely trapping the string within a corner of the label 750. Applicant finds that adhesive such as Velcro fasteners can cause fraying or other damage to the strings 760 when they are repeatedly placed in contact with one another. Both the shape and the location of the adhesive allow the label 750 to be employed to fasten the label securely and temporarily 750 to the basketball net without contact between the adhesive regions located on the back of the label 750 and the strings 760. Applicant finds that a combination of the shape of the label 750 and size and shape of the plurality of adhesive regions 756A-756D and the central adhesive region 758, respectively, provides the benefits described here.

Figure 8A:
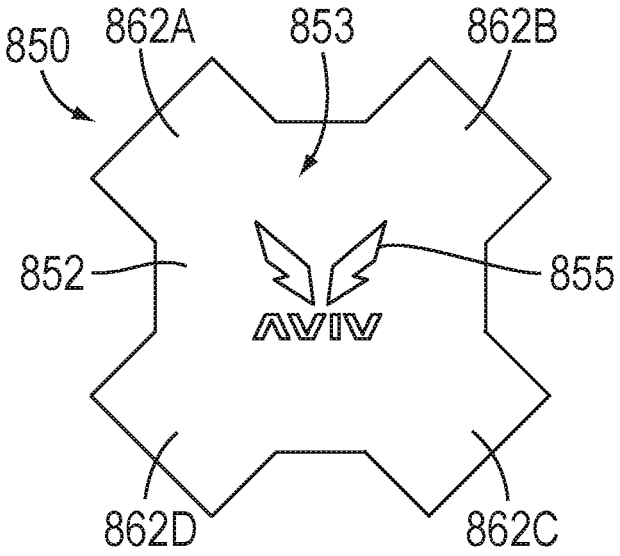
FIGS. 8A-8D illustrate a label in accordance with a second embodiment.
Figure 8B:
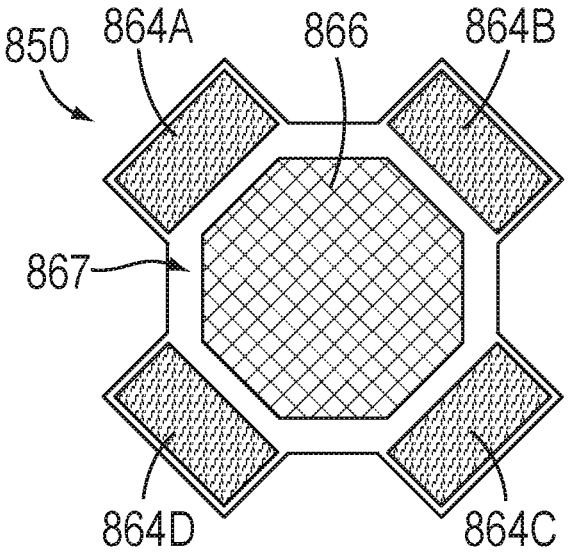

Referring now to FIGS. 8A-8D, a label is illustrated in accordance with a second embodiment. FIG. 8A illustrates a front view of the label 850. The label 850 includes a body 852, a front surface 853 and a plurality of tabs 862A-862D. Each of the plurality of tabs 862A, 862B, 862C and 862D extend radially outward from a respective corner of the body 852. A logo 855 is centrally located on the front surface 853. FIG. 8B illustrates a rear view of the label 850 including a rear surface 867. As viewed from the rear, the label 850 includes a plurality of adhesive regions 864A-864D each adhesive region located on the rear surface of one of the plurality of tabs 862A-862D, respectively. The label 850 also includes a central adhesive region 866 located on the rear surface 857.

Figure 8C:
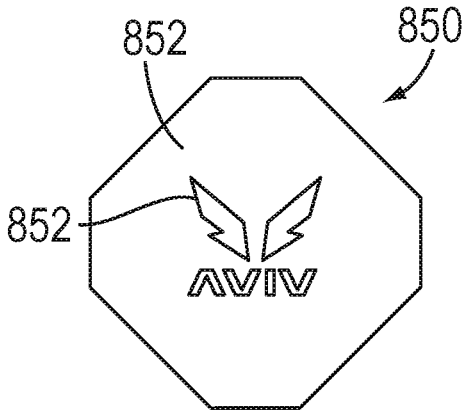

FIG. 8C illustrates a front view of the label 850 in a configuration where the plurality of tabs 862A-862D are folded backwards to place each of the plurality of tabs 862A-862D, respectively, in contact with the rear side of the label 850. According to this embodiment, the rearward fold allows each of the plurality of adhesive regions 864A-864D to be placed in contact with the central adhesive region 866. In various embodiments, the bond formed between the each of the respective plurality of adhesive regions 864A-864D and the central adhesive region 866 is secure but temporary. According to various embodiments, VELCRO hook and loop style fastening material is employed for each of the plurality of adhesive regions 864A-864D and the central adhesive region 866. In various embodiments, other forms of adhesive or other forms of fastening can be employed.

Figure 8D:
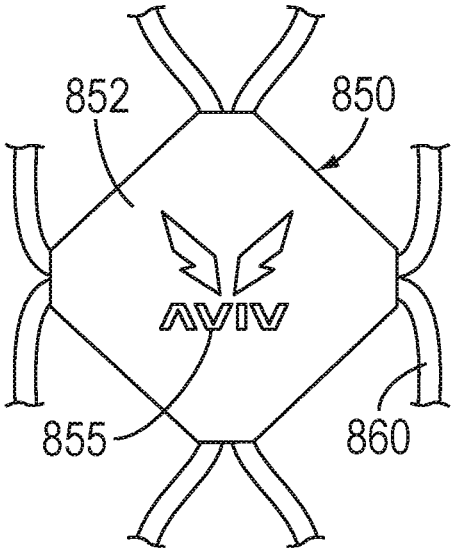

FIG. 8D illustrates a front view of the label 850 with the label secured to the strings 860 included in a basketball net. Here, the strings 860 are trapped within the fold formed when a tab 862A-862D is folded backward and pressed into engagement with the rear of the body 852. Further, the configuration illustrated in FIGS. 8A-8D allows four separate sections of string 860 to be secured within the folds of the label 850. When attached as illustrated the front surface 853 of the body 852 is unobstructed when viewed from the front of the net. Here too, the logo 855 is clearly displayed with the label attached to the net. Further, the manner of attachment provides the label with a secure attachment at each of four corners.

Figure 9A:
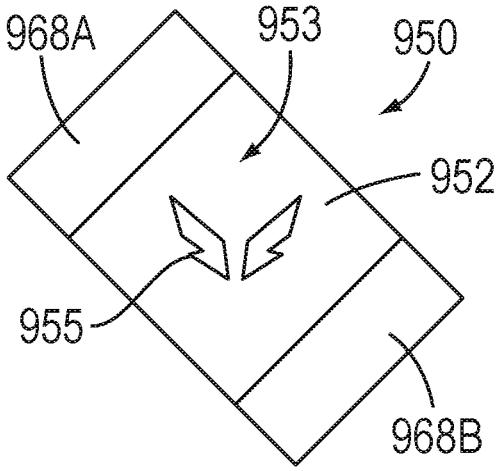
FIGS. 9A-9D illustrate a label in accordance with a third embodiment.
Figure 9B:
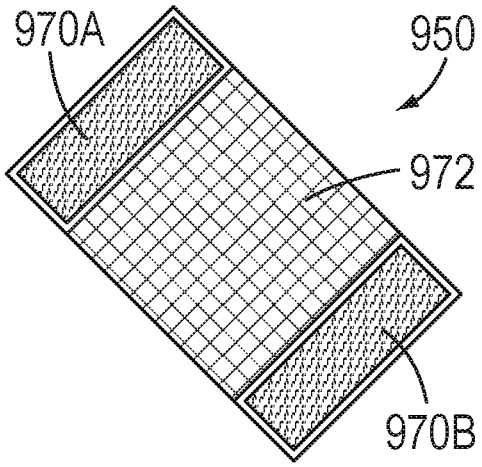

Referring now to FIGS. 9A-9D, a label is illustrated in accordance with a third embodiment. FIG. 9A illustrates a front view of the label 950. The label 950 includes a body 952, a front surface 953, a first end 968A and a second end 968B. The two ends 968A, 968B extend from opposite ends of the body 953. A logo 955 is centrally located on the front surface 953. FIG. 9B illustrates a rear view of the label 950. The rear side of the first end 968A and the rear side of the second end 968B each include an adhesive. As viewed from the rear, the label 950 includes a first adhesive region 970A located on the rear of the first end 968A and a second adhesive region 970B located on the rear of the second end 968B. The label 950 also includes a central adhesive region 972 located on the rear side of the label 950.

Figure 9C:
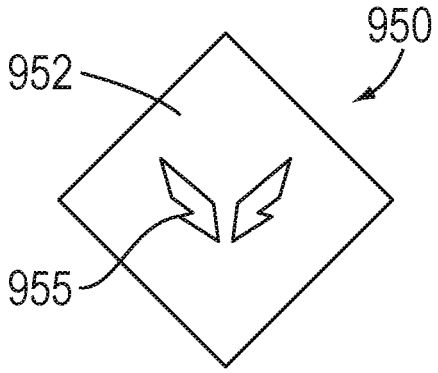

FIG. 9C illustrates a front view of the label 950 in a configuration where the first end 968A and the second end 968B are folded backwards to place each of the first adhesive region 970A and the second adhesive region 970B, respectively, in contact with the central adhesive region 972 located on the rear side of the label 950. The ends 968A, 968B are pressed into engagement with the rear side of the body 950 to securely attach the adhesive regions 970A, 970B and the central adhesive region 972. In various embodiments, the bond that is formed between each of the adhesive regions 970A, 970B and the central adhesive region 972 is secure but temporary. According to various embodiments, VELCRO hook and loop style fastening material is employed for the adhesive regions 970A, 970B and 972, respectively. In various embodiments, other forms of adhesive or other forms of fastening can be employed.

Figure 9D:
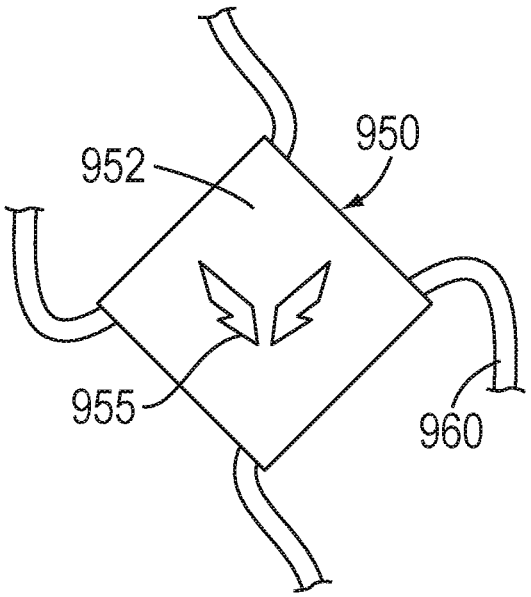

FIG. 9D illustrates a front view of the label 950 with the label secured to the strings 960 included in a basketball net. Here, the strings 960 are trapped within the fold formed when an end 968A, 968B is folded backward and pressed into engagement with the rear of the body 952. According to this embodiment, two separate sections of string 960 are secured within the folds of the label 950. When attached as illustrated the front surface 953 of the body 952 is unobstructed when viewed from the front of the net. Here too, the logo 955 is clearly displayed with the label attached to the net.

Figure 10A:
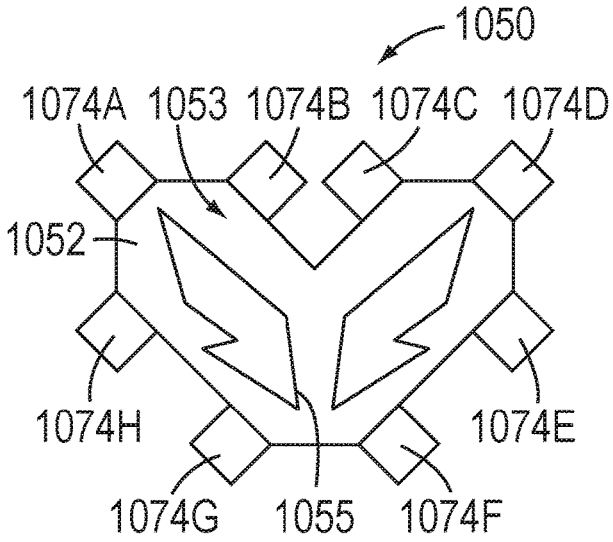
FIGS. 10A-10D illustrate a label in accordance with a fourth embodiment.
Figure 10B:
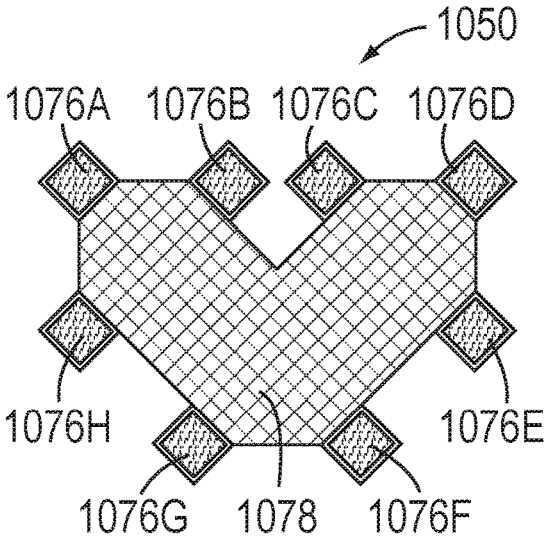

Referring now to FIGS. 10A-10D, a label is illustrated in accordance with a fourth embodiment. FIG. 10A illustrates a front view of the label 1050. The label 1050 includes a body 1052, a front surface 1053 and a plurality of tabs 1074A-1074H. Each of the plurality of tabs 1074A-1074H extend outward from the body 1052. A logo 1055 is centrally located on the front surface 1053. FIG. 10B illustrates a rear view of the label 1050. The rear side of the plurality of tabs 1074A-1074H include an adhesive. As viewed from the rear, the label 1050 includes a plurality of adhesive regions 1076A-1076H each adhesive region located on a rear side of one of the plurality of tabs 1074A-1074H, respectively. A central adhesive region 1078 is located on the rear side of the body 1052.

Figure 10C:
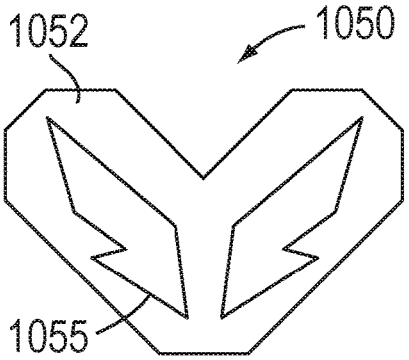

FIG. 10C illustrates a front view of the label 1050 in a configuration where the plurality of tabs 1074A-1074H are folded backwards to place each of the plurality of tabs 1074A-1074H, respectively, in contact with the rear side of the label 1050. According to this embodiment, the rearward fold allows each of the plurality of adhesive regions 1074A-1074H to be pressed into contact with the central adhesive region 1078, at different locations. In various embodiments, the bond formed between the each of the respective plurality of adhesive regions 1076A-1076H and the central adhesive region 1078 is secure but temporary.

According to various embodiments, VELCRO hook and loop style fastening material is employed for each of the plurality of adhesive regions 1076A-1076H and the central adhesive region 1078. In various embodiments, other forms of adhesive or other forms of fastening can be employed.

Figure 10D:
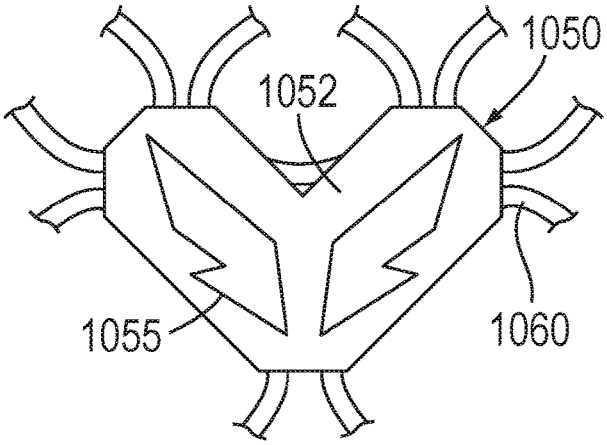

FIG. 10D illustrates a front view of the label 1050 with the label secured to the strings 1060 included in a basketball net. Here, the strings 1060 are trapped within the fold formed when a tab 1074A-1074H is folded backward and pressed into engagement with the rear of the body 1052. Further, the configuration illustrated in FIGS. 10A-10D allows eight separate sections of string 1060 to be secured within the folds of the label 1050. When attached as illustrated the front surface 1053 of the body 1052 is unobstructed when viewed from the front of the net. Here too, the logo 1055 is clearly displayed with the label attached to the net.

Figure 11A:
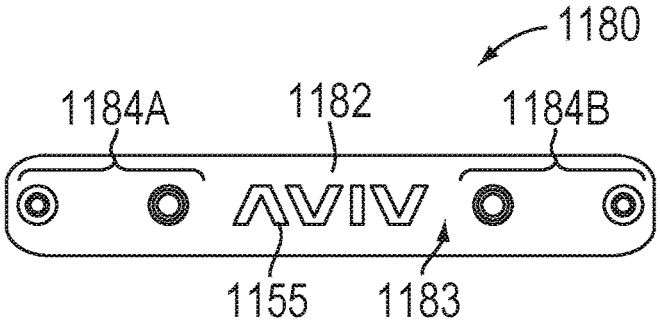
FIGS. 11A-11D illustrate a label in accordance with a fifth embodiment.
Figure 11B:
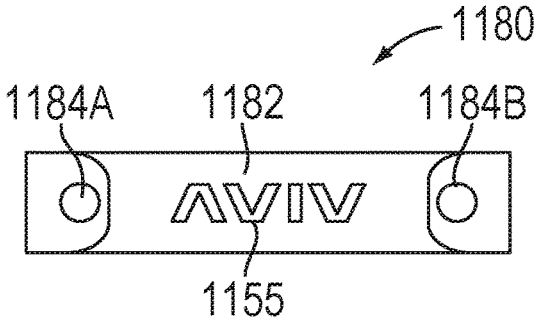

Referring now to FIGS. 11A-11D, a label 1180 is illustrated in accordance with a fifth embodiment. FIG. 11A illustrates a front view of the label 1180. The label 1180 includes a body 1182, a front surface 1183, a first snap 1184A located at a first end of the body 1182 and a second snap 1184B located at a second end of the body 1182 opposite the first end. FIG. 11A illustrates the first snap 1184A and the second snap 1184B in an open position. Each of the first snap 1184A and the second snap 1184B include a respective socket and stud visible in FIG. 11A. A logo 1155 is centrally located on the front surface 1183. FIG. 11B illustrates a front view of the label 1180 with the both the first snap 1184A and the second snap 1184B fastened in the closed position. A respective snap cap included in each of the first snap 1184A and the second snap 1184B is visible in FIG. 11B.

Figure 11C:
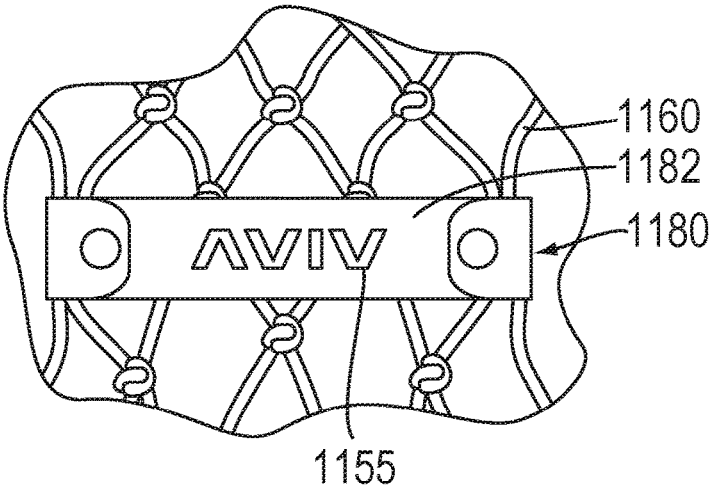
Figure 11D:
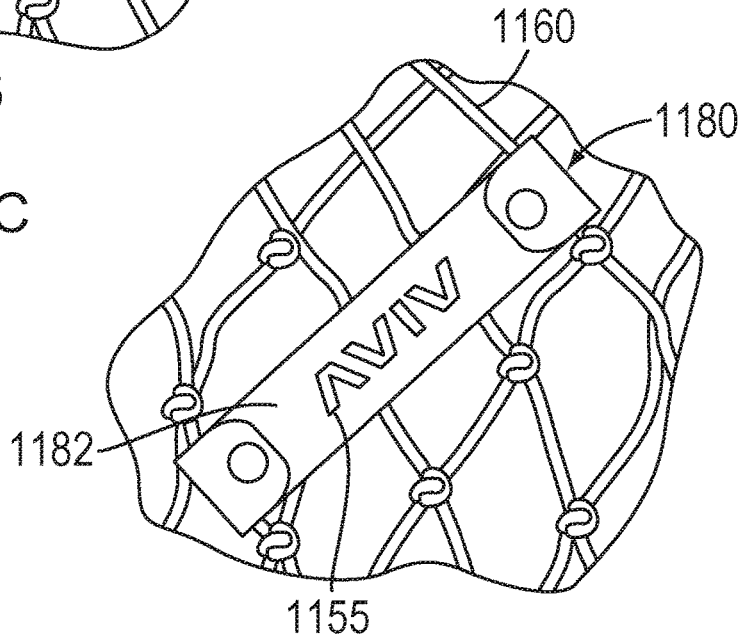

FIG. 11C illustrates the label 1180 attached to strings 1160 included in a basketball net. According to the illustrated embodiment, the label 1180 is securely attached to the basketball net by securing the first end of the label 1180 to one or more strings 1160 using the first snap 1184C and securing the second end of the label 1180 to one or more strings 1160 using the second snap 1184B. In operation, one or more strings are located between the socket and the stud of the snaps 1184A, 1184B, respectively. Each end of the label is folded on itself to engage the two elements of the snap and allow the secure fastening of the snap with a string captured within the label 1180 at each end. The shape and form factor of the label 1180 allows it to be employed in various orientations to display the logo. For example, FIG. 11C illustrates a first orientation in which the label is secured in a horizontal orientation. FIG. 11D illustrates a second orientation in which the label 1180 is secured in an angled orientation across the face of the net.

Figure 12A:
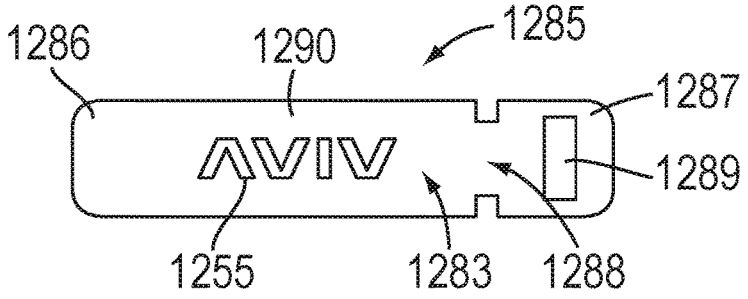
FIGS. 12A-12D illustrate a label in accordance with a sixth embodiment.
Figure 12B:
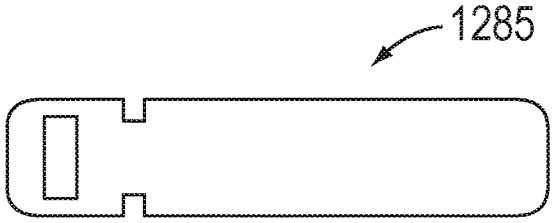

Referring now to FIGS. 12A-12D, a label 1285 is illustrated in accordance with a sixth embodiment. FIG. 12A illustrates a front view of the label 1285. The label 1285 includes a body 1290, a front surface 1283, a first end of the body 1286, a second end of the body 1287, a notched region 1288 and an opening 1289 that is defined in the second end of the body 1287. FIG. 12B illustrates a rear view of the label 1285 and a rear surface of the label.

Figure 12C:
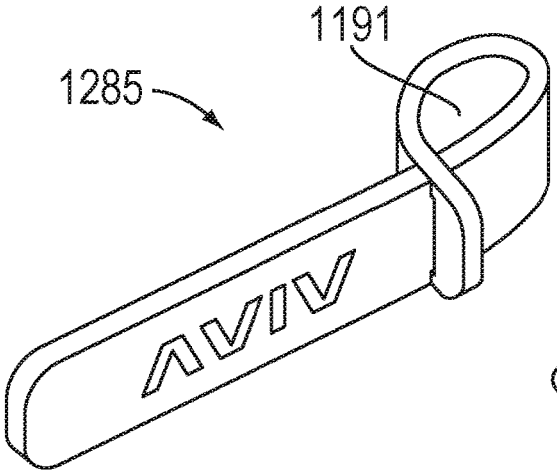

FIG. 12C illustrates the label 1285 in a fastened position. To fasten the label, the first end 1286 is folded backwards and inserted in the opening 1289. The first end is drawn through the opening 1289 wrapping on itself until the notches that define the notched region 1288 align with the walls that define the opening 1289. Here, the engagement between the notches and the walls of the opening provides a catch that fixes the label 1285 in a loop 1291. In various embodiments, a distance separating the notched region 1288 from a distal portion of the second end of the body 1287 establish an inner diameter of the loop 1291 with the label in the "latched" state illustrated in FIG. 12C.

Figure 12D:
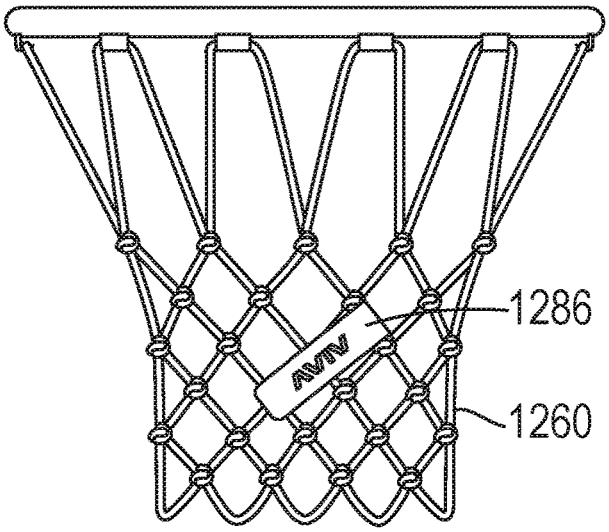

As illustrated in FIG. 12D, the label 1285 is attached to a string 1260 included in the basketball net. This is accomplished by locating the string adjacent the rear surface of the label 1285 when the first end 1286 is folded rearward and drawn through the opening 1289. The label 1285 is securely attached to the string 1260 when the label 1285 is placed in the latched position illustrated in FIG. 12C with the string 1260 enclosed within the opening 1291.

Figure 13A:
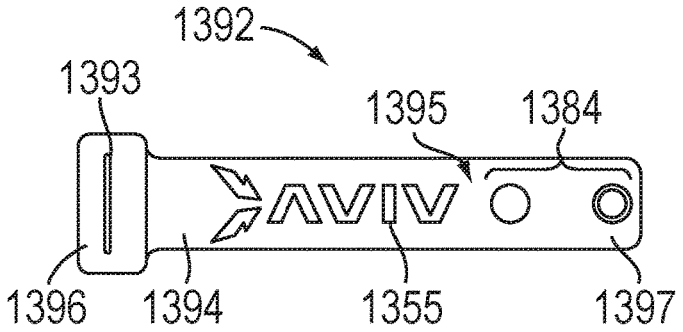
FIGS. 13A-13C illustrate a label in accordance with a seventh embodiment.
Figure 13B:
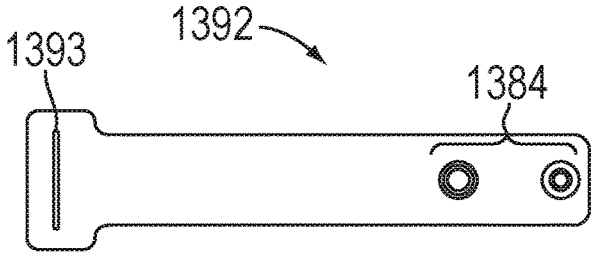
Figure 13C:
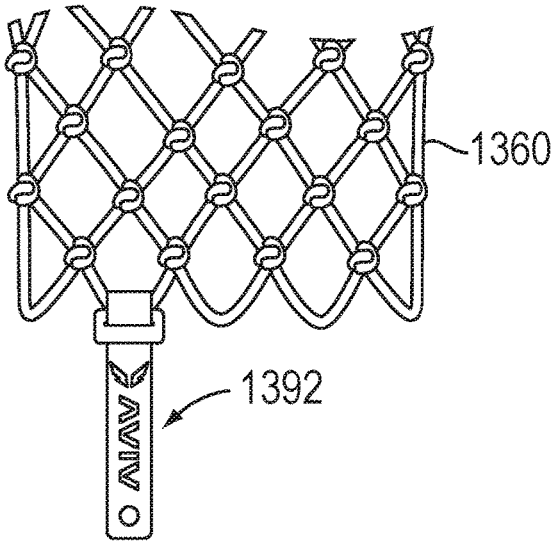

Referring now to FIGS. 13A-13C, a label 1392 is illustrated in accordance with a seventh embodiment. FIG. 13A illustrates a front view of the label 1392. The label 1392 includes a body 1394, a front surface 1395, a slit 1393 located at a first end 1396 of the body and a snap 1384 located at a second end 1397 of the body. FIG. 13B illustrates a rear view of the label 1392 and a rear surface of the label. The configuration of the label 1392 allows the label to be attached to a basketball net in one of two hanging configurations. FIG. 13C illustrates a first configuration in which a string 1360 is trapped within a loop formed when the second end 1397 of the label is inserted within the slit 1393 with the string 1360 proximate a rear side of the label 1392. The resulting attachment is illustrated in FIG. 13C. In an alternative form of attachment, the snap 1384 is employed as described with reference to the fifth embodiment above.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A basketball net, comprising:

a multi-layer cord including each of a first layer formed of a first antimicrobial, moisture wicking fiber and a second layer including a second moisture wicking fiber, wherein:

the multi-layer cord defines the basketball net having a plurality of knots and a plurality of openings, the basketball net includes a plurality of loops at a first end thereof configured for attachment to a basketball rim, the basketball net is configured in a conical shape having a central opening, a first diameter of the basketball net at the first end thereof is larger than a second diameter of the basketball net at a second end thereof, and wherein the basketball net is configured to wipe moisture from a surface of a basketball passing through the basketball net.

2. The basketball net of claim 1, wherein the first layer is an outer layer woven from a first antimicrobial, moisture wicking yarn to form a wall that defines a central opening, and wherein the second layer includes at least one cord located within the central opening, the at least one cord formed by a second moisture wicking yarn.

3. The basketball net of claim 2, wherein the at least one cord includes a plurality of cords including a first cord formed by the second moisture wicking yarn and a second cord including a third moisture wicking yarn.

4. The basketball net of claim 3, wherein the plurality of cords includes: the first cord; the second cord including the third moisture wicking yarn and at least one monofiber yarn; and a third cord formed by a plurality of monofiber yarns.

5. The basketball net of claim 2, wherein the first antimicrobial, moisture wicking yarn includes a first yarn having antimicrobial, moisture wicking characteristics covered by a second yarn having antimicrobial, moisture wicking characteristics.

6. The basketball net of claim 5, wherein the first antimicrobial, moisture wicking yarn includes a first linear density and a first thread count, wherein the second yarn has a second linear density that is the same as the first linear density, and wherein the second yarn has a second thread count that is the same as the first thread count.

7. The basketball net of claim 1, wherein the first antimicrobial, moisture wicking fiber includes a first synthetic fiber including a first antimicrobial nanoparticle, and wherein the second moisture wicking fiber includes a second synthetic fiber.

8. The basketball net of claim 7, wherein the first antimicrobial nanoparticle is a first metal nanoparticle including at least one of silver and copper.

9. The basketball net of claim 7, wherein the first antimicrobial nanoparticle is distributed substantially uniformly throughout the first antimicrobial, moisture wicking fiber.

10. The basketball net of claim 1, wherein at least one of the first antimicrobial fiber and the second antimicrobial fiber is sprayed with an antimicrobial solution.

11. The basketball net of claim 1, wherein the basketball net is dipped in an antimicrobial solution.

12. A removable label for employment with a basketball net, wherein the removable label includes a body with a plurality of corners and having a front surface with indicia displayed thereon, wherein a tab extends radially outward from each of the plurality of corners, respectively, wherein an adhesive region is provided on a rear surface of each of the respective tabs, wherein a central adhesive region is provided on a rear surface of the body, wherein an adhesive free region is located between the central adhesive region and each of the respective tabs, the adhesive free region sized and shaped to locate a cord of the basketball net proximate the rear surface and absent contact between the cord and either the respective adhesive regions provided on the rear surface of the respective tabs or the central adhesive region, with the respective tabs folded around the cord to securely attach the removable label to the basketball net.

13. The basketball net of claim 1, wherein the first layer is an outer layer that defines a hollow outer cord, and wherein the second layer is an inner layer located within the hollow outer cord.

14. The basketball net of claim 1, wherein the first layer is configured to wipe the moisture from the surface of the basketball and the second layer is configured to wick the moisture from the first layer.

15. A basketball goal, comprising a backboard;

a rim configured to secure to the backboard; and a basketball net configured to hang from the rim, the basketball net comprising a multi-layer cord including each of a first layer formed of a first antimicrobial, moisture wicking fiber and a second layer including a second moisture wicking fiber, wherein the basketball net is configured to wipe moisture from a surface of a basketball passing through the basketball net.

16. The basketball goal of claim 15, wherein the first layer is an outer-layer is woven from a first antimicrobial, moisture wicking yarn to form a wall that defines a central opening, and wherein the second layer includes at least one cord located within the central opening, the at least one cord formed by a second moisture wicking yarn.

17. The basketball goal of claim 16, wherein the at least one cord includes a plurality of cords including a first cord formed by the second moisture wicking yarn and a second cord including a third moisture wicking yarn.

18. The basketball goal of claim 17, wherein the plurality of cords includes: the first cord; the second cord including the third moisture wicking yarn and at least one monofiber yarn; and a third cord formed by a plurality of monofiber yarns.

19. The basketball goal of claim 15, wherein the first layer is an outer layer woven of the first antimicrobial, moisture wicking yarn to form a hollow cord having a wall that defines a central opening extending axially within the multi-layer cord, and wherein the second layer is located within the outer cord.

20. The basketball goal of claim 15, wherein the first layer is configured to wipe the moisture from the surface of the basketball and the second layer is configured to wick the moisture from the first layer.

21. An antimicrobial, moisture wicking material for sports netting, comprising:

a multi-layer cord including each of a first layer formed of a first antimicrobial, moisture wicking fiber and a second layer including a second antimicrobial, moisture wicking fiber, wherein:

the multi-layer cord defines the sports netting having a plurality of knots and a plurality of openings, the sports netting is configured in a conical shape having a central opening, a first diameter of the sports netting at the first end thereof is larger than a second diameter of the sports netting at a second end thereof, and wherein the sports netting is configured to wipe moisture from a surface of a ball passing through the sports netting.

22. The antimicrobial, moisture wicking material for sports netting of claim 21, wherein the first layer is an outer layer woven from a first antimicrobial, moisture wicking yarn to form a wall that defines a central opening, and wherein the second layer includes at least one cord located within the central opening, the at least one cord formed by a second moisture wicking yarn.

23. The antimicrobial, moisture wicking material for sports netting of claim 22, wherein the at least one cord includes a plurality of cords including a first cord formed by the second moisture wicking yarn and a second cord formed by a monofiber yarn.

24. The antimicrobial, moisture wicking material for sports netting of claim 21, wherein the multi-layer cord includes a longitudinal axis; an outer cord of the first layer formed of a first antimicrobial, moisture wicking yarn, the outer cord forming a wall for 360 degrees about the longitudinal axis for a length of the multi-layer cord, the wall defining a hollow central region within the outer cord; and a plurality of inner cords of the second layer located within the hollow central region.

25. The antimicrobial, moisture wicking material for sports netting of claim 24, wherein the plurality of inner cords include a first inner cord manufactured of an moisture, wicking yarn and a second inner cord manufactured of a monofiber yarn.

26. The antimicrobial, moisture wicking material for sports netting of claim 21, wherein the first layer is configured to wipe the moisture from the surface of the ball and the second layer is configured to wick the moisture from the first layer.

* * * * *